US009063491B2

(12) United States Patent
Matsunaka et al.

(10) Patent No.: US 9,063,491 B2
(45) Date of Patent: Jun. 23, 2015

(54) ELECTROPHOTOGRAPHIC FIXING MEMBER, FIXING APPARATUS AND ELECTROPHOTOGRAPHIC IMAGE FORMING APPARATUS

(71) Applicant: CANON KABUSHIKI KAISHA, Tokyo (JP)

(72) Inventors: Katsuhisa Matsunaka, Inagi (JP); Kazuo Kishino, Yokohama (JP); Masaaki Takahashi, Yokohama (JP); Katsuya Abe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/283,866

(22) Filed: May 21, 2014

(65) Prior Publication Data

US 2014/0255068 A1 Sep. 11, 2014

Related U.S. Application Data

(63) Continuation of application No. PCT/JP2013/007404, filed on Dec. 17, 2013.

(30) Foreign Application Priority Data

Dec. 19, 2012 (JP) ..... 2012-277247
Dec. 26, 2012 (JP) ..... 2012-282972

(51) Int. Cl.
*G03G 15/20* (2006.01)

(52) U.S. Cl.
CPC .... *G03G 15/2057* (2013.01); *G03G 2215/2035* (2013.01)

(58) Field of Classification Search
CPC ..... G03G 15/169; G03G 15/2021; G03G 15/2053; G03G 15/2057; G03G 15/224; G03G 2215/1695; G03G 2215/2035
See application file for complete search history.

(56) References Cited

U.S. PATENT DOCUMENTS

| | | | |
|---|---|---|---|
| 7,457,577 | B2 | 11/2008 | Matsunaka et al. |
| 7,725,068 | B2 | 5/2010 | Matsunaka et al. |
| 7,734,241 | B2 | 6/2010 | Nishida et al. |
| 7,979,015 | B2 | 7/2011 | Matsunaka et al. |
| 7,991,341 | B2 | 8/2011 | Matsunaka et al. |

(Continued)

FOREIGN PATENT DOCUMENTS

| | | | |
|---|---|---|---|
| JP | 2001-62380 | A | 3/2001 |
| JP | 2002-213432 | A | 7/2002 |

(Continued)

OTHER PUBLICATIONS

International Search Report in Application No. PCT/JP2013/007404 (dated Mar. 11, 2014).

*Primary Examiner* — Roy Y Yi
(74) *Attorney, Agent, or Firm* — Fitzpatrick, Cella, Harper & Scinto

(57) ABSTRACT

The present invention is directed to providing a fixing member that has a flexible surface and that can supply a larger amount of heat to a material to be recorded and a toner in a shorter period of time. The fixing member comprises a substrate, an elastic layer and a releasing layer, wherein thermal effusivity in a depth region from a surface of the releasing layer is 1.5 [kJ/(m$^2$·K·sec$^{0.5}$)] or more, the depth region corresponding to a thermal diffusion length when an alternating-current temperature wave having a frequency of 10 Hz is applied to the surface of the releasing layer, and a surface micro rubber hardness is 85 degrees or less.

13 Claims, 8 Drawing Sheets

(56) References Cited

U.S. PATENT DOCUMENTS

| | | | | |
|---|---|---|---|---|
| 2012/0308281 | A1* | 12/2012 | Wu et al. | 399/333 |
| 2014/0248071 | A1* | 9/2014 | Matsunaka et al. | 399/328 |
| 2014/0255067 | A1 | 9/2014 | Matsunaka et al. | |
| 2014/0301763 | A1 | 10/2014 | Miura et al. | |

FOREIGN PATENT DOCUMENTS

| | | | |
|---|---|---|---|
| JP | 2002-268423 | A | 9/2002 |
| JP | 2004-45851 | A | 2/2004 |
| JP | 2006-84679 | A | 3/2006 |
| JP | 2006-259712 | A | 9/2006 |
| JP | 2008-58749 | A | 3/2008 |
| JP | 2008-176300 | A | 7/2008 |
| JP | 2012-225986 | A | 11/2012 |
| WO | 2014/103252 | A1 | 7/2014 |
| WO | 2014/103263 | A1 | 7/2014 |

* cited by examiner

ELECTROPHOTOGRAPHIC FIXING MEMBER, FIXING APPARATUS AND ELECTROPHOTOGRAPHIC IMAGE FORMING APPARATUS

CROSS-REFERENCE TO RELATED APPLICATIONS

This application is a continuation of International Application No. PCT/JP2013/007404, filed Dec. 17, 2013, which claims the benefit of Japanese Patent Application No. 2012-277247, filed Dec. 19, 2012 and Japanese Patent Application No. 2012-282972, filed Dec. 26, 2012.

BACKGROUND OF THE INVENTION

1. Field of the Invention

The present invention relates to an electrophotographic fixing member. The present invention also relates to a fixing apparatus and an electrophotographic image forming apparatus using the member.

2. Description of the Related Art

In general, in a heat-fixing apparatus for use in an electrophotographic system such as a laser printer or a copier, rotation members such as a pair of a heated roller and a roller, a film and a roller, a belt and a roller, and a belt and a belt are in pressure-contact with each other.

Then, a material to be recorded, which holds an image by an unfixed toner, is introduced to a pressure-contact portion (fixing nip) formed between the rotation members, and heated, and thus the toner is molten to fix the image to the material to be recorded such as paper.

The rotation member with which the unfixed toner image held on the material to be recorded is in contact is referred to as a fixing member, and is called a fixing roller, a fixing film or a fixing belt depending on the form thereof.

As such fixing members, those having the following configuration are known.

A configuration in which a substrate formed of a metal, a heat resistant resin or the like is covered with a silicone rubber elastic layer having heat resistance and a releasing layer made of a fluororesin, the layers sandwiching a silicone rubber adhesive therebetween.

A configuration in which a releasing layer is formed by forming a coat of a coating material including a fluororesin on a silicone rubber elastic layer and firing the coat at a temperature equal to or higher than the melting point of the fluororesin.

The fixing member having such a configuration can enclose and melt a toner image in the fixing nip without excessively compressing the toner image, with the use of an excellent elastic deformation of the silicone rubber elastic layer. Therefore, the fixing member has an effect of preventing image displacement and bleeding, and improving color mixing in particular when fixing a color image of multicolor construction. The fixing member also has an effect of following the irregularities of fibers of paper as the material to be recorded, to prevent the occurrence of melting unevenness of toner.

Furthermore, the function of the fixing member is demanded to supply to a material to be recorded a sufficient amount of heat for instantaneously melting a toner in a fixing nip portion.

Against such a problem, a configuration in Japanese Patent Application Laid-Open No. 2004-45851 is known in which a high heat capacity material is incorporated to a part of a fixing member to allow the fixing member to ensure a high heat capacity, resulting in the increase in amount of heat supplied to the material to be recorded. Since a larger amount of heat can be thus stored in the fixing member, the configuration is considered to be effective for electric power saving and an increase in speed.

In addition, in Japanese Patent Application Laid-Open No. 2002-268423, a fixing belt has been proposed in which carbon fibers formed by a vapor growth method are contained in an elastic layer to thereby improve the heat conductivity of the elastic layer. In addition, the present inventors have proposed a heat-fixing member in which carbon fibers, and an orientation inhibitory component of the carbon fibers, such as silica, alumina or iron oxide are contained in an elastic layer to thereby improve the heat conductivity of the elastic layer in the thickness direction (Japanese Patent Application Laid-Open No. 2006-259712).

SUMMARY OF THE INVENTION

Meanwhile, as described above, in a fixing process, thermal energy is supplied to the material to be recorded and a toner in the fixing nip portion formed between the fixing member that is in contact with the unfixed toner and a pressure member that oppositely abuts on the fixing member. A toner is thus molten, passes through the fixing nip and is then cooled and solidified, and therefore is fixed on the material to be recorded to form a fixing image.

While the width of the fixing nip in a fixing unit can be appropriately designed depending on the configurations of the fixing member and the pressure member as well as the pressure applied, the width is generally designed more widely in a higher speed and larger size apparatus and less widely in a lower speed and smaller size apparatus. The reason for such design is because a time for retaining the material to be recorded in the fixing nip (dwell time) is ensured to thereby supply a sufficient amount of heat to a toner for melting. In particular, in the case of a color image, unfixed toner images of multiple colors are present while being stacked in many layers, and thus a large amount of heat is needed for allowing the toner images to be sufficiently fixed.

When the dwell time is expressed by T, the fixing nip width is expressed by N, and the conveyance velocity of a member to be heated in the fixing unit is expressed by V, T, N and V satisfy a relationship of $T=N/V$.

The dwell time is designed to be about 30 to 100 msec in a common fixing apparatus. However, since a higher speed (increase in conveyance velocity (V)) and a smaller size (decrease in fixing nip width (N)) have been recently demanded, fixing performance has been demanded to be ensured in a shorter dwell time.

As reviewing the performance of the fixing member, the present inventors have considered that it is effective to apply the concepts of thermal diffusion length and thermal effusivity which are known in the field of heat-transfer engineering.

When the thermal behavior between the fixing member in the fixing nip and a toner or the material to be recorded is examined, heat is periodically drawn from the fixing member by a toner or the material to be recorded that are relatively low temperature materials.

The present inventors have considered that when the heat is assumed as an Alternating-current temperature wave having a frequency f, what depth from the surface of the fixing member in the fixing nip the heat reaches is found out to thereby enable to find out what range from the surface of the fixing member the thermal characteristics of the fixing member are controlled in.

Herein, a thermal diffusion length (μ) is defined as a distance at which the amplitude of the alternating-current temperature wave attenuates to 1/e when the alternating-current temperature wave is diffused in a specimen, and is known to be expressed by the following expression (1). In the following expression (1), symbol α denotes the thermal diffusivity of the specimen.

$$\mu=(\alpha/(\pi \cdot f))^{0.5} \quad (1)$$

When the expression is examined with respect to the fixing member, it is considered that a thermal influence received by the fixing member, when the heat is transferred from the fixing member heated toward the low temperature materials, reaches a predetermined depth from the surface, the depth corresponding to the thermal diffusion length determined by assigning the thermal diffusivity of the fixing member and the inverse number of the dwell time to the expression (1).

The above consideration can mean that the ability of the fixing nip to supply heat from the fixing member to the low temperature materials is almost controlled by the thermal characteristics of the fixing member in the range from the surface of the fixing member to the predetermined depth. The fixing member generally has a multilayer configuration including a substrate, an elastic layer and a releasing layer, and thus the thermal diffusion length when heat stimulation is provided on the surface of the member depends on the thickness and thermophysical properties of each layer.

Then, it is considered that it is effective to introduce the concept of thermal effusivity to the ability of the fixing member to supply heat to the low temperature materials. That is, the thermal effusivity is a parameter for use as an index of an ability to give or draw heat when two articles having a different temperature are brought into contact with each other. Then, the thermal effusivity is expressed by the following expression (2).

$$b=(\lambda \cdot C_p \cdot \rho)^{0.5} \quad (2)$$

In the expression (2), λ denotes heat conductivity, $C_p$ denotes specific heat at constant pressure and ρ denotes density, and the thermal effusivity can be derived as an average value by the weighted average of the percent of thicknesses in the case of a multilayer configuration. In addition, $C_p \cdot \rho$ denotes heat capacity per unit volume (=volume heat capacity).

To summarize the above considerations, it is considered that the thermal performances of the fixing member are almost determined by the thermal effusivity in the depth region from the surface, corresponding to the thermal diffusion length.

Meanwhile, not only the enhancement in ability to supply heat to a member to be heated but also the reduction in micro rubber hardness on the surface is demanded for the fixing member, as described above. The ability of the fixing member to supply heat to a member to be heated can be enhanced by increasing the content of a filler in the predetermined depth region from the surface of the fixing member, corresponding to the thermal diffusion length.

However, the increase in amount of a filler added in the region may cause the enhancement in micro rubber hardness on the surface of a fixing part. The content of a filler in the elastic layer has been conventionally adjusted appropriately depending on the properties of the filler to be contained in the elastic layer, in order to suppress the increase in hardness of the fixing member. However, in consideration of a dwell time of 30 msec to 100 msec or a further higher speed of an electrophotographic image forming process in the future, it is necessary to achieve such a configuration as to enable to solve the two conflicting problems at a higher level than a conventional one.

Accordingly, the present invention is directed to providing a fixing member whose surface is flexible, having high thermal effusivity in the vicinity of the surface.

The present invention is also directed to providing a fixing apparatus that can favorably fix a toner on a recording medium even in a short dwell time, as well as an electrophotographic image forming apparatus.

The present inventors have made intensive studies in order to simultaneously achieve, at a higher level, the two conflicting objects of the increase in flexibility of the surface and the enhancement in thermal effusivity in the vicinity of the surface. As a result, the present inventors have found that a fixing member can be obtained which has a surface micro rubber hardness of as flexible as 85° or less regardless of having high thermal effusivity in the vicinity of the surface, which could not be achieved by a conventional configuration. The present invention is based on such a finding.

According to one aspect of the present invention, there is provided an electrophotographic fixing member comprising a substrate, an elastic layer and a releasing layer, wherein thermal effusivity in a depth region from a surface of the releasing layer is 1.5 [kJ/(m$^2$·K·sec$^{0.5}$)] or more, the depth region corresponding to a thermal diffusion length when an alternating-current temperature wave having a frequency of 10 Hz is applied to the surface of the releasing layer, and a surface micro rubber hardness is 85° or less.

According to another aspect of the present invention, there is provided a fixing apparatus comprising the above mentioned fixing member and a heating unit of the fixing member.

According to further aspect of the present invention, there is provided an electrophotographic image forming apparatus comprising the above mentioned fixing apparatus.

According to the present invention, a fixing member that has high thermal effusivity in the vicinity of the surface thereof while the flexibility of the surface can be obtained. Further, according to the present invention, a fixing apparatus that can stably provide sufficient heat to a toner and a medium to be recorded while excessive pressure-contact of the toner is suppressed, can be obtained.

Furthermore, according to the present invention, an electrophotographic image forming apparatus that can stably provide a high-definition image can be obtained.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The fixing member according to the present invention is described below based on a specific configuration.

Figure 1:
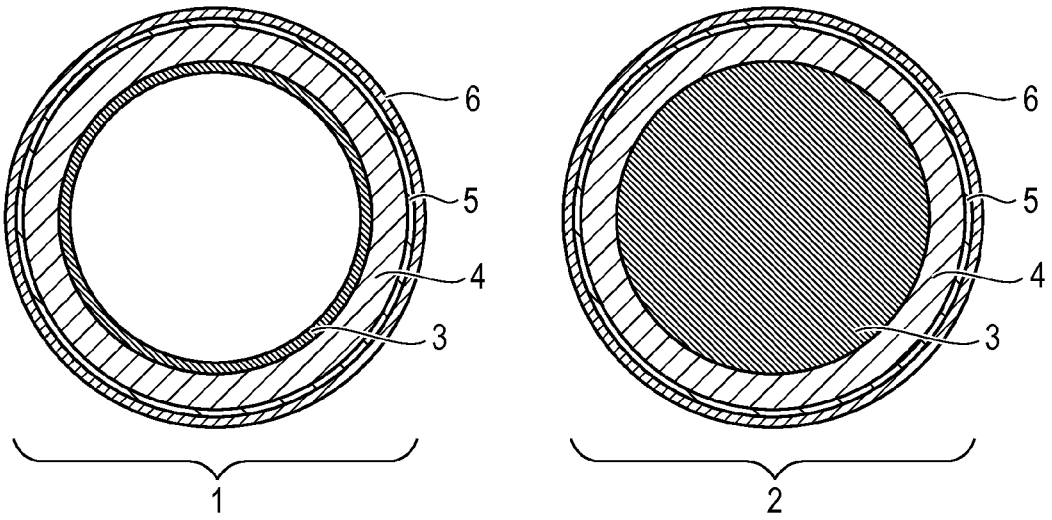
FIG. 1 is a schematic transverse cross-sectional view of the fixing member according to the present invention.

FIG. 1 is a schematic cross-sectional view of a fixing belt as the fixing member according to the present invention. In a fixing belt 1 illustrated in FIG. 1, reference numeral 3 denotes a metallic substrate, reference numeral 4 denotes an elastic layer, reference numeral 6 denotes a releasing layer, and reference numeral 5 denotes an adhesive layer that bonds the elastic layer 4 and the releasing layer 6.

Herein, with respect to each of the substrate 3, the elastic layer 4, the adhesive layer 5 and the releasing layer 6, the thickness, the thermal diffusivity, the density, the specific heat capacity and the heat conductivity are defined as listed in Table 1 below.

TABLE 1

| | Thickness | Thermal diffusivity | Density ($\rho$) | Specific heat at constant pressure ($C\rho$) | Thermal conductivity |
|---|---|---|---|---|---|
| Substrate 3 | t1 | $\alpha 1$ | $\rho 1$ | c1 | $\lambda 1$ |
| Elastic layer 4 | t2 | $\alpha 2$ | $\rho 2$ | c2 | $\lambda 2$ |
| Adhesive layer 5 | t3 | $\alpha 3$ | $\rho 3$ | c3 | $\lambda 3$ |
| Releasing layer 6 | t4 | $\alpha 4$ | $\rho 4$ | c4 | $\lambda 4$ |

The degree of attenuation of an alternating-current temperature wave applied to the releasing layer 6, in the releasing layer 6, can be found by a magnitude relationship between the thermal diffusion length $[\mu 4_f=(\alpha 4/(\pi \cdot f))^{0.5}]$ determined by the thermal diffusivity ($\alpha 4$) of the releasing layer 6 and the frequency f of the alternating-current temperature wave, and the thickness t4 of the releasing layer 6. In other words, when a relationship of $t4 \geq \mu 4_f$ is satisfied, the relationship means that the alternating-current temperature wave sufficiently attenuates in the releasing layer 6. That is, the thermal diffusion length ($\mu_f$) of the fixing belt is equal to $\mu 4_f$.

On the other hand, when $t4<\mu 4_f$ is satisfied, the alternating-current temperature wave does not sufficiently attenuate in the releasing layer 6. Therefore, the alternating-current temperature wave passes through the releasing layer 6 and reaches the adhesive layer 5. The degree of attenuation of the alternating-current temperature wave in the adhesive layer 5 here can be calculated as follows. When the alternating-current temperature wave that passes through the releasing layer 6 and reaches the adhesive layer 5 is expressed by a frequency conversion $f_2$, $f_{2=\alpha 4}/(\pi \cdot (\mu 4-t4)^2)$ is derived by transformation of the expression 1.

In other words, when $t4<\mu 4_f$ is satisfied, it can be considered that the satisfaction is equivalent to providing of the alternating-current temperature wave having a frequency $f_2$ to the adhesive layer 5. Then, the degree of attenuation of the alternating-current temperature wave in the adhesive layer 5 can be found by a magnitude relationship between the thermal diffusion length $[\mu 3_f=(\alpha 3/(\pi \cdot f_2))^{0.5}]$ determined by the thermal diffusivity ($\alpha 3$) of the adhesive layer 5 and the frequency $f_2$ of the alternating-current temperature wave, and the thickness t3 of the adhesive layer. In other words, if a relationship of $t3 \geq \mu 3_f$ is satisfied, the relationship means that the alternating-current temperature wave ($f_2$) sufficiently attenuates in the adhesive layer 5. Accordingly, the thermal diffusion length ($\mu_f$) of the fixing belt is equal to $t4+\mu 3_f$.

On the other hand, when $t3<\mu 3_f$ is satisfied, the alternating-current temperature wave (f2) does not sufficiently attenuate in the adhesive layer 5, and reaches the elastic layer 4. In the case, the degree of attenuation of the alternating-current temperature wave in the elastic layer 4 can be likewise calculated as follows. When the alternating-current temperature wave that passes through the adhesive layer 5 and reaches the elastic layer 4 is expressed by a frequency conversion $f_3$, $f_3=\alpha 3/(\pi \cdot (\mu 3_f-t3)^2)$ is derived by transformation of the expression 1. In other words, when $\mu 3_f>t3$ is satisfied, it can be considered that the satisfaction is equivalent to providing of the alternating-current temperature wave having a frequency $f_3$ to the elastic layer 4. Then, the degree of attenuation of the alternating-current temperature wave in the elastic layer 4 can be found by a magnitude relationship between the thermal diffusion length $[\mu 2_f=(\alpha 2/(\pi \cdot f_3))^{0.5}]$ determined by the thermal diffusivity ($\alpha 2$) of the elastic layer 4 and the frequency ($f_3$) of the alternating-current temperature wave, and the thickness t2 of the elastic layer 4. In other words, if a relationship of $t2 \geq \mu 2_f$ is satisfied, the relationship means that the Alternating-current temperature wave ($f_3$) sufficiently attenuates in the elastic layer 4. Accordingly, the thermal diffusion length ($\mu_f$) of the fixing belt here is equal to $t4+t3+\mu 2$.

On the other hand, when $t2<\mu 2_f$ is satisfied, the alternating-current temperature wave ($f_3$) does not sufficiently attenuate in the elastic layer 4, and further reaches the substrate 3. In the case, the degree of attenuation of the alternating-current temperature wave in the substrate 3 can be likewise calculated as follows. When the Alternating-current temperature wave that passes through the elastic layer 4 and reaches the substrate 3 is expressed by a frequency conversion $f_4$, $f_4=\alpha 2/(\pi \cdot (\mu 2_f-t2)^2)$ is derived by transformation of the expression 1. In other words, when $t2<\mu 2_f$ is satisfied, it can be considered that the satisfaction is equivalent to providing of the alternating-current temperature wave having a frequency $f_4$ to the substrate 3. Then, the degree of attenuation of the alternating-current temperature wave in the substrate 3 can be found by a magnitude relationship between the thermal diffusion length $[\mu 1_f=(\alpha 1/(\pi \cdot f_4))^{0.5}]$ determined by the thermal diffusivity ($\alpha 1$) of the substrate 3 and the frequency ($f_4$) of the alternating-current temperature wave, and the thickness t1 of the substrate 3. In other words, if a relationship of $t1 \geq \mu 1_f$ is satisfied, the relationship means that the alternating-current temperature wave ($f_4$) sufficiently attenuates in the substrate 3. Accordingly, the thermal diffusion length ($\mu_f$) of the fixing belt here is equal to $t4+t3+t2+\mu 1_f$. On the other hand, when $t1<\mu 1_f$ is satisfied, the alternating-current temperature wave ($f_4$) does not sufficiently attenuate even in the substrate 3, and reaches a medium (air or the like) on the back side of the substrate 3. That is, since the alternating-current temperature wave serves as a system thermally passing through the fixing belt, it can be considered that the thermal diffusion length ($\mu_f$)

is equal to t4+t3+t2+t1. Thus, the thermal diffusion length ($\mu_f$) when the alternating-current temperature wave having a frequency f is applied to the surface of the fixing belt is determined. Then, by using the characteristic value of each of the layers present within the depth region from the surface, the region corresponding to the thermal diffusion length ($\mu_f$), the thermal effusivity $b_f$ in the depth region can be determined. That is, in the above described configuration, the alternating-current temperature wave having a frequency f is assumed to pass through the releasing layer 6 and the adhesive layer 5 to sufficiently attenuate in the elastic layer 4. In the case, the releasing layer 6, the adhesive layer 5 and the elastic layer 4 are present in the depth region corresponding to the thermal diffusion length. When the thermal effusivities in the layers are here defined as b6, b5 and b4, respectively, b6, b5 and b4 re expressed as follows:

$$b6=(\lambda 6\cdot c6\cdot \rho 6)^{0.5}$$

$$b5=(\lambda 5\cdot c5\cdot \rho 5)^{0.5}$$

$$b4=(\lambda 4\cdot c4\cdot \rho 4)^{0.5}$$

Then, $b_f$ can be determined by the following expression according to the weighted average.

$$b_f=((b6\cdot t6)/(\mu_f))+(b5\cdot t5)/(\mu_f))+(b4\cdot \mu 4_f)/(\mu_f)).$$

As described above, $b_f$ thus determined serves as a parameter showing the thermal performance as the heat-fixing member. Then, a larger value of $b_f$ means a higher ability to supply heat to the material to be recorded.

(First Embodiment)

Then, the present invention is described by taking as an example a fixing member in which the substrate 3, the elastic layer 4, the adhesive layer 5 and the releasing layer 6 are stacked in this order. The surface of the releasing layer 6 is in contact with a member to be heated. Herein, a nickel-plated film is used as the substrate 3, a silicone rubber adhesive is used as the adhesive layer 5, and a tube made of a copolymer (PFA) of tetrafluoroethylene (TFE) and perfluoroalkyl vinyl ether (FVA) is used as the releasing layer 6. The thicknesses and the values of various physical properties of the substrate 3, the adhesive layer 5 and the releasing layer 6 are shown in Table 2 below.

TABLE 2

| | Thickness (μm) | Thermal diffusivity ($mm^2$/sec) | Density ($g/cm^3$) | Specific heat at constant pressure (J/g · K) | Thermal conductivity (W/(m · K)) |
|---|---|---|---|---|---|
| Substrate 3 | 40 | 22.75 | 8.9 | 0.447 | 90.5 |
| Adhesive layer 5 | 5 | 0.11 | 0.97 | 1.9 | 0.2 |
| Releasing layer 6 | 10 | 0.12 | 2.17 | 0.96 | 0.24 |

Then, the thermal diffusion length ($\mu 4_{10}$) when an alternating-current temperature wave having a frequency of 10 Hz is applied to the surface of the releasing layer of such a fixing belt is calculated.

$$\mu 4_{10}=(0.12/(\pi\cdot f))^{0.5}=61.8\times 10^{-3}\ \text{mm}=61.8\ \mu\text{m}$$

Since the value is larger than a thickness (=10 μm) of the releasing layer 6, the alternating-current temperature wave does not attenuate in the releasing layer 6 and reaches the adhesive layer 5. Then, the thermal diffusion length ($\mu 3_{10}$) in the adhesive layer 5 is calculated. When the temperature wave that reaches the adhesive layer 5 is converted to the frequency ($f_2$) of the alternating-current temperature wave, the frequency ($f_2$) can be determined by the following expression.

$$f_2=0.12/(\pi\cdot(\mu 4_{10}-t4)^2)=14.2\ \text{Hz}$$

That is, the state equivalent to application of an alternating-current temperature wave of 14.2 Hz to the adhesive layer 5 is achieved. Therefore, μ3 is determined by the following expression.

$$\mu 3_{10}=(0.11/(\pi\cdot f_2))^{0.5}=49.6\ \mu\text{m}$$

Since the value is larger than a thickness (t3=5 μm) of the adhesive layer 5, the alternating-current temperature wave does not attenuate even in the adhesive layer 5 and reaches the elastic layer 4. If the elastic layer 4 here has sufficiently high thermal effusivity, the alternating-current temperature wave attenuates in the elastic layer 4.

Herein, the thermal effusivities b6 and b5 of the releasing layer 6 and the adhesive layer 5 can be calculated by the following expressions, respectively.

$$b6=(\lambda 6\cdot c6\cdot \rho 6)^{0.5}=0.71\ [\text{kJ}/(\text{m}^2\cdot\text{K}\cdot\text{sec}^{0.5})]$$

$$b5=(\lambda 5\cdot c5\cdot \rho 5)^{0.5}=0.61\ [\text{kJ}/(\text{m}^2\cdot\text{K}\cdot\text{sec}^{0.5})]$$

When the temperature wave that reaches the elastic layer 4 is converted to the frequency ($f_3$) of the alternating-current temperature wave, the frequency ($f_3$) can be determined by the following expression.

$$f_3=0.11/(\pi\cdot(\mu 3_{10}-t3)^2)=17.6\ \text{Hz}$$

That is, the state equivalent to application of an alternating-current temperature wave of 17.6 Hz to the elastic layer 4 is achieved.

Then, the case is supposed in which each of 4A, 4B, 4C and 4D having a configuration and values of physical properties shown in Table 3 below is used as the elastic layer, and the thermal diffusion length and the thermal effusivity are calculated.

TABLE 3

| | Thickness (μm) | Thermal diffusivity ($mm^2$/sec) | Density ($g/cm^3$) | Specific heat at constant pressure (J/g · K) | Thermal conductivity (W/(m · K)) |
|---|---|---|---|---|---|
| Elastic layer 4A | 300 | 0.13 | 0.97 | 1.60 | 0.20 |
| Elastic layer 4B | 300 | 0.38 | 2.28 | 0.97 | 0.84 |
| Elastic layer 4C | 300 | 0.44 | 1.00 | 1.59 | 0.70 |
| Elastic layer 4D | 300 | 1.11 | 2.31 | 0.97 | 2.49 |

Herein, the elastic layer 4A, the elastic layer 4B, the elastic layer 4C and the elastic layer 4D correspond to an elastic layer material for use in Comparative Example A-5, an elastic layer material for use in Comparative Example A-3, an elastic layer material for use in Comparative Example A-6 and an elastic layer material for use in Example A-3, described later, respectively.

Although the detail will be described in the sections of Examples and Comparative Examples, the elastic layer 4A is only made of a cured product of an addition-curing type silicone rubber having no filler having heat conductivity. The elastic layer 4B is formed by compounding an alumina filler in a volume percent of 45% to an addition-curing type silicone rubber and curing the resultant. The elastic layer 4C is formed by compounding vapor grown carbon fibers in a volume percent of 2% to an addition-curing type silicone rubber and curing the resultant. The elastic layer 4D is likewise formed by compounding an alumina filler in a volume percent of 45% and vapor grown carbon fibers in a volume percent of 2% to an addition-curing type silicone rubber and curing the resultant.

<Case of Using Elastic Layer 4A>

The thermal diffusion length ($\mu 2_{10(4A)}$) in the elastic layer 4A is calculated. Herein, the temperature wave that reaches the elastic layer 4A is determined as the frequency ($f_3$) of the alternating-current temperature wave, and thus $\mu 2_{10(4A)}$ is as follows:

$$\mu 2_{10(4A)}=(0.13/(\pi \cdot f_3))^{0.5}=48.5\ \mu m$$

and is smaller than a thickness of 300 μm of the elastic layer. In other words, it is found that the alternating-current temperature wave sufficiently attenuates in the elastic layer 4. That is, the thermal diffusion length $\mu_{10(4A)}$ in the belt is as follows:

$$\mu_{10(4A)}=t4+t3+\mu 2_{10(4A)}=63.5\ \mu m.$$

In addition, the thermal effusivity $b4_{(4A)}$ of the elastic layer 4A here is as follows:

$$b4_{(4A)} = (\lambda 4_{(4A)} \cdot c4_{(4A)} \cdot \rho 4_{(4A)})^{0.5} = 0.56[kJ/(m^2 \cdot K \cdot sec^{0.5})].$$

Therefore, the thermal effusivity $b_{10(4A)}$ in the thermal diffusion length $\mu_{10(4A)}$, when an alternating-current temperature wave of 10 Hz is applied to the fixing belt, is as follows:

$$b_{10(4A)}=((b6 \cdot t6)/(\mu_{10(4A)}))+((b5 \cdot t5)/(\mu_{10(4A)}))+((b4_{(4A)} \cdot \mu 2_{10(4A)})/(\mu_{10(4A)}))=0.59\ [kJ/(m^2 \cdot K \cdot sec^{0.5})]$$

and it is found that when the elastic layer is a silicone rubber layer in which no filler is filled, sufficient thermal effusivity, namely, supply of heat to a toner or a non-recording material is not achieved.

<Case of Using Elastic Layer 4B>

The thermal diffusion length ($\mu 2_{10(4B)}$) in the elastic layer 4B is calculated.

$\mu 2_{10(4B)}$ is as follows:

$$\mu 2_{10(4B)}=(0.38/(\pi \cdot f_3))^{0.5}=82.9\ \mu m,$$

and is again smaller than a thickness of 300 μm of the elastic layer.

In other words, it is found that the alternating-current temperature wave sufficiently attenuates in the elastic layer 4B. That is, the thermal diffusion length $\mu_{10(4B)}$ in the belt is as follows:

$$\mu_{10(4B)}=t4+t3+\mu 2_{10(4B)}=97.9\ \mu m.$$

In addition, the thermal effusivity $b4_{10(4B)}$ of the elastic layer 4B here is as follows:

$$b4_{(4B)}=(\lambda 4_{(4B)} \cdot c4_{(4B)} \cdot \rho 4_{(4B)})^{0.5}=1.36\ [kJ/(m^2 \cdot K \cdot sec^{0.5})].$$

Therefore, the thermal effusivity $b_{10(4B)}$ in the thermal diffusion length $\mu_{10(4B)}$, when an alternating-current temperature wave of 10 Hz is applied to the fixing belt, is as follows:

$$b_{10(4B)}=((b6 \cdot t6)/(\mu_{10(4B)}))+((b5 \cdot t5)/(\mu_{10(4B)}))+((b4_{(4B)} \cdot \mu 2_{10(4B)})/(\mu_{10(4B)}))=1.26\ [kJ/(m^2 \cdot K \cdot sec^{0.5})].$$

That is, it is found that while an alumina filler is compounded in the elastic layer to thereby enhance thermal effusivity as compared with the case of being not compounded, sufficient thermal effusivity is not yet achieved.

<Case of Using Elastic Layer 4C>

The thermal diffusion length ($\mu 2_{10(4C)}$) in the elastic layer 4C is calculated. $\mu 2_{10(4C)}$ is as follows:

$$\mu 2_{10(4C)}=(0.44/(\pi \cdot f_3))^{0.5}=89.2\ \mu m,$$

and is again smaller than a thickness of 300 μm of the elastic layer. In other words, it is found that the alternating-current temperature wave sufficiently attenuates in the elastic layer 4C.

That is, the thermal diffusion length $\mu_{10(4C)}$ in the belt is as follows:

$$\mu_{10(4C)}=t4+t3+\mu 2_{10(4C)}=104.2\ \mu m.$$

In addition, the thermal effusivity $b4_{(4C)}$ of the elastic layer 4C here is as follows:

$$b4_{(4C)}=(\lambda 4_{(4C)} \cdot c4_{(4C)} \cdot \rho 4_{(4C)})^{0.5}=1.05\ [kJ/(m^2 \cdot K \cdot sec^{0.5})].$$

Therefore, the thermal effusivity $b_{10(4C)}$ in the thermal diffusion length $\mu_{10(4C)}$, when an alternating-current temperature wave of 10 Hz is applied to the fixing belt, is as follows:

$$b_{10(4C)}=(b6 \cdot t6)/(\mu_{10(4C)}))+(b5 \cdot t5)/(\mu_{10(4C)}))+((b4_{(4C)} \cdot \mu 2_{10(4C)})/(\mu_{10(4c)}))=1.00\ [kJ/(m^2 \cdot K \cdot sec^{0.5})].$$

That is, it is found that while vapor grown carbon fibers are compounded in the elastic layer to thereby enhance thermal effusivity as compared with the case of being not compounded, sufficient thermal effusivity is not yet achieved also in the case.

<Case of Using Elastic Layer 4D>

The thermal diffusion length ($\mu 2_{10(4D)}$) in the elastic layer 4D is calculated.

$\mu 2_{10(4D)}$ is as follows:

$$\mu 2_{10(4D)}=(1.11/(\pi \cdot f_3))^{0.5}=141.7\ \mu m,$$

and also in the case, is again smaller than a thickness of 300 μm of the elastic layer. In other words, it is found that the alternating-current temperature wave sufficiently attenuates also in the elastic layer 4D.

That is, the thermal diffusion length $\mu_{10(4D)}$ in the belt is as follows:

$$\mu_{10(4D)}=t4+t3+\mu 2_{10(4D)}=156.7\ \mu m.$$

In addition, the thermal effusivity $b4_{(4D)}$ of the elastic layer 4D here is as follows:

$$b4_{(4D)} = (\lambda 4_{(4D)} \cdot c4_{(4D)} \cdot \rho 4_{(4D)})^{0.5} = 2.36[kJ/(m^2 \cdot K \cdot sec^{0.5})].$$

and is very high thermal effusivity. The thermal effusivity $b_{10(4D)}$ in the thermal diffusion length $\mu_{10(4D)}$, when an alternating-current temperature wave of 10 Hz is applied to the fixing belt, is as follows:

$$b_{10(4D)}=(b6 \cdot t6)/(\mu_{10(4D)}))+((b5 \cdot t5)/(\mu_{10(4D)}))+((b4_{(4D)} \cdot \mu 2_{10(4D)})/(\mu_{10(4D)}))=2.20\ [kJ/(m^2 \cdot K \cdot sec^{0.5})]$$

and it is found that an alumina filler and vapor grown carbon fibers are compounded together in the elastic layer to thereby drastically enhance the thermal effusivity of the fixing belt as compared with the case of each being compounded singly. That is, it is indicated that the ability to supply heat to a toner and a non-recording material is enhanced at such a level that cannot be ever achieved.

(Second Embodiment)

A fixing belt in which a nickel-plated film is used as the substrate 3, the silicone rubber elastic layer 4D used above is used as the elastic layer 4, the adhesive layer 5 is not provided, and the releasing layer 6 is directly formed by a fluororesin coating is taken as an example. The configurations and the values of physical properties of the respective layers are shown in Table 4 below.

TABLE 4

| | Thickness (μm) | Thermal diffusivity ($mm^2$/sec) | Density (g/$cm^3$) | Specific heat at constant pressure (J/g · K) | Thermal conductivity (W/(m · K)) |
|---|---|---|---|---|---|
| Substrate 3 | 40 | 22.75 | 8.90 | 0.45 | 90.50 |
| Elastic layer 4D | 300 | 1.11 | 2.31 | 0.97 | 2.49 |
| Releasing layer 6 | 10 | 0.12 | 2.17 | 1.00 | 0.26 |

The fixing belt has a configuration corresponding to Example B-2.

The thermal diffusion length ($\mu 4_{10}$), when an alternating-current temperature wave having a frequency of 10 Hz is applied to the surface of the releasing layer of such the fixing belt, is calculated.

$$\mu 4_{10}=(0.12/(\pi \cdot f))^{0.5}=61.8\times 10^{-3}\ \text{mm}=61.8\ \mu\text{m}$$

Since the value is larger than a thickness (=10 μm) of the releasing layer 6, the alternating-current temperature wave does not attenuate in the releasing layer 6 and reaches the elastic layer 4D. Herein, the thermal effusivity b6 in the releasing layer 6 can be calculated by the following expression.

$$b6=(\lambda 6 \cdot c6 \cdot \rho 6)^{0.5}=0.75\ [\text{kJ}/(\text{m}^2 \cdot \text{K} \cdot \text{sec}^{0.5})]$$

Then, the thermal diffusion length ($\mu 2_{10(4D)}$) in the elastic layer 4D is calculated. Herein, when the temperature wave that reaches the elastic layer 4D is converted to the frequency ($f_3$) of the alternating-current temperature wave, the frequency ($f_3$) can be determined by the following expression.

$$f_3=0.12/(\pi \cdot (\mu 4_{10}-t4)^2)=14.2\ \text{Hz}$$

That is, the state equivalent to application of an alternating-current temperature wave of 14.2 Hz to the elastic layer 4D is achieved. Therefore, $\mu 2_{10(4D)}$ is determined by the following expression.

$$\mu 2_{10(4D)}=(1.11/(\pi \cdot f_3))^{0.5}=157.7\ \mu\text{m}$$

In the case, $\mu 2_{10(4D)}$ is smaller than a thickness of 300 μm of the elastic layer. In other words, it is found that the alternating-current temperature wave sufficiently attenuates in the elastic layer 4D. That is, the thermal diffusion length $\mu_{10(4D)}$ in the belt is as follows:

$$\mu_{10(4D)}=t4+\mu 2_{10(4D)}=167.7\ \mu\text{m}.$$

In addition, as described above, the thermal effusivity $b4_{(4D)}$ of the elastic layer 4D here is as follows:

$$b4_{(4D)}=2.36\ [\text{kJ}/(\text{m}^2 \cdot \text{K} \cdot \text{sec}^{0.5})].$$

Therefore, the thermal effusivity $b_{10(4D)}$ in the thermal diffusion length $\mu_{10(4D)}$, when an alternating-current temperature wave of 10 Hz is applied to the fixing belt, is as follows:

$$b_{10(4D)} = ((b6 \cdot t6)/(\mu_{10(4D)})) + ((b4_{(4D)} \cdot \mu_{(4D)})/(4_{(4D)}))$$

$$= 2.26[\text{kJ}/(\text{m}^2 \cdot \text{K} \cdot \text{sec}^{0.5})],$$

and the releasing layer is directly formed without no adhesive layer formed, thereby enabling to further enhance the thermal effusivity in the vicinity of the surface of the member.

(1) Schematic Configuration of Fixing Member

The detail of the present invention is described using the drawings.

FIG. 1 is a schematic cross-sectional view illustrating one aspect of the electrophotographic fixing member according to the present invention, and reference numeral 1 denotes a fixing member having a belt shape (fixing belt) and reference numeral 2 denotes a roller-shaped fixing member (fixing roller). In general, the fixing member is called a fixing belt in the case where a substrate itself is deformed to thereby form a fixing nip, and is called a fixing roller in the case where a substrate itself is hardly deformed and a fixing nip is formed by elastic deformation of an elastic layer.

In FIG. 1, reference numeral 3 denotes a substrate, reference numeral 4 denotes an elastic layer that covers the periphery of the substrate 3, and reference numeral 6 denotes a releasing layer. The releasing layer 6 may be secured to the periphery of the elastic layer 4 by an adhesive layer 5.

Figure 2:
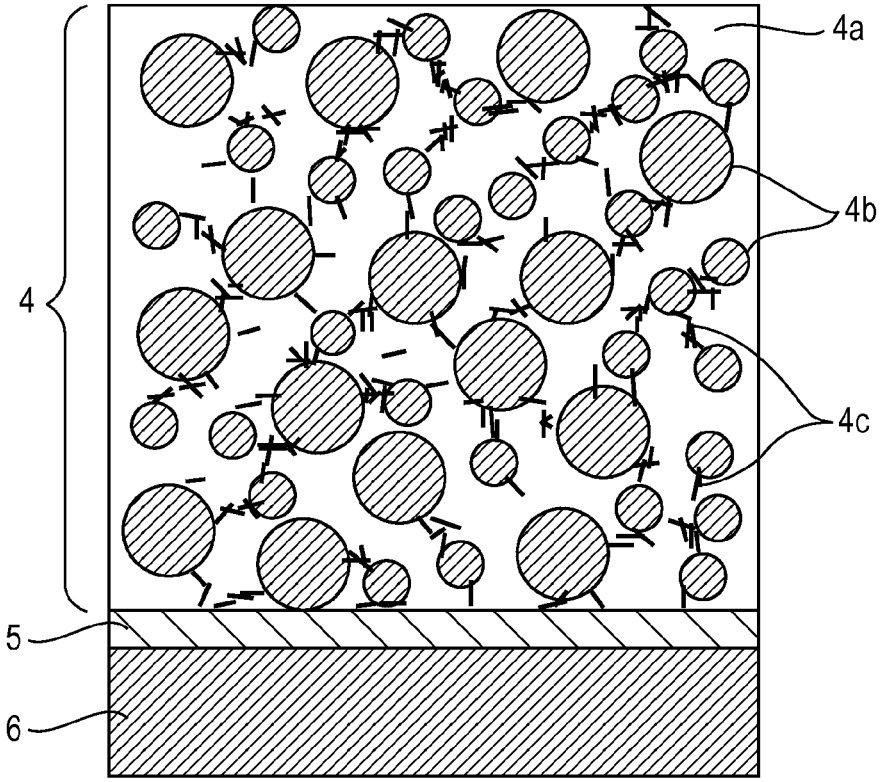
FIG. 2 is a schematic cross-sectional view in a range of 100 μm from the surface of the fixing member according to the present invention.

In addition, FIG. 2 is a view schematically representing an enlarged cross-section of a layer configuration of the range from the surface of the fixing member to the thermal diffusion length μ. In FIG. 2, reference numeral 4 denotes an elastic layer, reference character 4*a* denotes a silicone rubber as a base material, reference character 4*b* denotes a filling material having a high volume heat capacity, and reference character 4*c* denotes vapor grown carbon fibers. Such respective components constituting the elastic layer are described later in detail.

As illustrated in FIG. 2, the vapor grown carbon fibers 4*c* entwined with one another are present in the elastic layer 4 in the form of bridge between the fillers 4*b* having a high volume heat capacity. That is, it is considered that the fillers 4*b* having a high volume heat capacity are bridged by the vapor grown carbon fibers 4*c* to thereby form a heat conducting path. Therefore, a fixing member having an excellent ability to supply heat can be obtained while the total amount (volume percent) of the filler added to the elastic layer, the filler increasing the hardness of the elastic layer, is suppressed.

Reference numeral 5 denotes an adhesive layer and reference numeral 6 denotes a releasing layer. The layers also include vapor grown carbon fibers to thereby enable to enhance the ability of the fixing member to supply heat. The methods for forming the layers are also described later in detail.

Hereinafter, each of the layers in the fixing member will be described and the utilizing method thereof will be described.

(2) Substrate

As the substrate 3, for example, a metal or an alloy such as aluminum, iron, stainless or nickel, or a heat resistant resin such as polyimide is used.

When the fixing member has a roller shape, a core is used for the substrate 3. Examples of the material of the core include metals and alloys such as aluminum, iron and stainless. The core may have a hollow interior portion, as long as the core has such a strength that withstands pressure in a fixing apparatus. In addition, when the core has a hollow shape, the interior thereof can also be provided with a heat source.

When the fixing member has a belt shape, examples of the substrate 3 include a nickel-plated sleeve and a stainless sleeve, and a heat resistant resin belt made of polyimide or the like. The interior surface of the fixing member may be further provided with a layer (not illustrated) for imparting functions such as wear resistance and heat insulating property. The exterior surface thereof may be further provided with a layer (not illustrated) for imparting functions such as adhesiveness.

(3) Elastic Layer and Method for Producing Same

The elastic layer 4 functions as a layer that allows the fixing member to carry such elasticity that allows the fixing member to follow the irregularities of fibers of paper without compressing a toner at the time of fixing.

In order to exert such a function, a heat resistant rubber such as a silicone rubber or a fluororubber can be used, and in particular a product obtained by curing an addition-curing type silicone rubber can be used as a base material in the elastic layer 4. The reason for this is because the addition-curing type silicone rubber is often in the state of a liquid to allow a filler to be easily dispersed, and the degree of crosslinking of the addition-curing type silicone rubber is adjusted depending on the type and the amount of a filler added, described later, to thereby enable to adjust elasticity.

In addition, with respect to the layer configuration, an elastic layer portion included in the range from the surface of the fixing member to the thermal diffusion length μ is limited from the viewpoint of heat-conducting efficiency to a material to be recorded, but a thickness range out of the above range is not limited. In particular, the roller-shaped fixing member can take any of various forms in a range out of the range from the surface to the thermal diffusion length μ for the purpose of imparting further functions such as flexibility, heat-conducting property and heat insulating property.

(3-1) Addition-Curing Type Silicone Rubber

In FIG. 2, the silicone rubber 4*a* is made of an addition-curing type silicone rubber.

In general, an addition-curing type silicone rubber includes an organopolysiloxane having an unsaturated aliphatic group, an organopolysiloxane having active hydrogen connected to silicon, and a platinum compound as a crosslinking catalyst.

Examples of the organopolysiloxane having an unsaturated aliphatic group include the following:

linear organopolysiloxane in which both ends of a molecule are each represented by $(R^1)_2R^2SiO_{1/2}$, and intermediate units of a molecule are represented by $(R^1)_2SiO$ and $R^1R^2SiO$; and branched polyorganosiloxane in which intermediate units include $R^1SiO_{3/2}$ or $SiO_{4/2}$.

Herein, each $R^1$ represents a monovalent unsubstituted or substituted hydrocarbon group connected to a silicon atom and not including an aliphatic unsaturated group. Specific examples include the following:

alkyl groups (for example, methyl, ethyl, propyl, butyl, pentyl and hexyl);

aryl groups (phenyl group and the like); and substituted hydrocarbon groups (for example, chloromethyl, 3-chloropropyl, 3,3,3-trifluoropropyl, 3-cyanopropyl and 3-methoxypropyl).

In particular, from the viewpoints of allowing synthesis and handling to be easy and achieving an excellent heat resistance, 50% or more of $R^1$ (s) preferably represent a methyl group, and all of $R^1$ (s) particularly preferably represent a methyl group.

In addition, each $R^2$ represents an unsaturated aliphatic group connected to a silicon atom, examples thereof include vinyl, allyl, 3-butenyl, 4-pentenyl and 5-hexenyl, and each $R^2$ can be vinyl from the viewpoints of allowing synthesis and handling to be easy, and also easily performing a crosslinking reaction.

In addition, the organopolysiloxane having active hydrogen connected to silicon is a crosslinking agent that reacts with an alkenyl group in the organopolysiloxane component having an unsaturated aliphatic group by a catalytic action of the platinum compound to form a crosslinking structure.

The number of hydrogen atoms connected to a silicon atom is a number of more than 3 in average in one molecule.

Examples of an organic group connected to a silicon atom include an unsubstituted or substituted monovalent hydrocarbon group having the same meaning as $R^1$ in the organopolysiloxane component having an unsaturated aliphatic group. In particular, the organic group can be a methyl group because of being easily synthesized and handled.

The molecular weight of the organopolysiloxane having active hydrogen connected to silicon is not particularly limited.

In addition, the viscosity of the organopolysiloxane at 25° C. is preferably in a range of 10 $mm^2/s$ or more and 100,000 $mm^2/s$ or less, and more preferably 15 $mm^2/s$ or more and 1,000 $mm^2/s$ or less. The reason for the range is because no case occurs in which the organopolysiloxane volatilizes during storage not to provide the desired degree of crosslinking and the desired physical properties of a formed product, and the organopolysiloxane can be easily synthesized and handled, and easily dispersed in a system uniformly.

Any of linear, branched and cyclic siloxane backbones may be adopted and a mixture thereof may be adopted. In particular, a linear siloxane backbone can be adopted because of allowing synthesis to be easy. A Si—H bond may be present in any siloxane unit in a molecule, but at least a part thereof can be partially present in a siloxane unit at an end of a molecule, like an $(R^1)_2HSiO_{1/2}$ unit.

As the addition-curing type silicone rubber, one having an amount of an unsaturated aliphatic group of 0.1% by mol or more and 2.0% by mol or less based on 1 mol of a silicon atom can be adopted. In particular, the amount is in a range of 0.2% by mol or more and 1.0% by mol or less.

(3-2) About Filler

The elastic layer 4 includes a filler for enhancing the heat conducting characteristic of the fixing member, and imparting reinforcing property, heat resistance, processability, conductivity and the like.

(3-2-1) Material

In particular, in order to enhance the heat conducting characteristic, the filler can be an inorganic filler having a high heat conductivity and a high volume heat capacity. Specific examples of the inorganic filler can include a metal and a metal compound.

In particular, for example, the following material is suitably used as the inorganic filler for the purpose of enhancing the heat conducting characteristic: silicon carbide; silicon nitride; boron nitride; aluminum nitride; alumina; zinc oxide; magnesium oxide; silica; copper; aluminum; silver; iron; nickel; or the like.

Furthermore, from the viewpoint of ensuring the volume heat capacity of the elastic layer, a filler having a high volume heat capacity of 3.0 [$mJ/m^3 \cdot K$] or more and including alumina, magnesium oxide, zinc oxide, iron, copper or nickel as a main component can be used.

In FIG. 2, reference numeral 4*b* denotes the filler (inorganic filler) having a high volume heat capacity, described herein.

The above filler can be used singly or as a mixture of two or more thereof. The average particle diameter can be in a range of 1 μm or more and 50 μm or less from the viewpoints of handling and dispersibility. In addition, while a filler having a spherical shape, a pulverized shape, a needle shape, a plate shape, a whisker shape or the like is used, a filler having a spherical shape, a pulverized shape or the like can be used from the viewpoint of dispersibility.

Herein, the average particle diameter of the inorganic filler in the elastic layer is determined by a flow type particle image analyzing apparatus (trade name: FPIA-3000; manufactured by Sysmex Corporation).

Specifically, a sample cut out from the elastic layer is placed in a crucible, and heated to 1000° C. in a nitrogen atmosphere to ash the rubber component for removal. The inorganic filler included in the sample is present in the crucible at the stage. When the elastic layer contains vapor grown carbon fibers described later, as the filler, the vapor grown carbon fibers are also present in the crucible.

Then, when the vapor grown carbon fibers coexist with the inorganic filler in the crucible, the crucible is heated to 1000° C. under an air atmosphere to burn the vapor grown carbon fibers. As a result, only the inorganic filler included in the sample remains in the crucible.

Then, the inorganic filler in the crucible is ground using a mortar and a pestle so as to provide primary particles, and then the primary particles are dispersed in water to prepare a specimen liquid. The specimen liquid is charged to the particle image analyzing apparatus, and is introduced into an imaging cell in the apparatus and allowed to pass through the cell to shoot the inorganic filler as a static image.

The diameter of a circle (hereinafter, also referred to as "equal area circle") having the same area as the area of a particle image planar projected (hereinafter, also referred to as "particle projection image") of the inorganic filler is defined as the diameter of the inorganic filler according to the particle image. Then, the equal area circles of 1000 particles of the inorganic filler are determined, and the arithmetic average value thereof is defined as the average particle diameter of the inorganic filler.

The volume heat capacity of the filler can be determined by the product of a specific heat at constant pressure ($C_p$) and a true density (ρ), and each value can be determined by each of the following apparatuses.

Specific heat at constant pressure ($C_p$): differential scanning calorimeter (trade name: DSC823e; manufactured by Mettler-Toledo International Inc.)

Specifically, an aluminum pan is used as each of a sample pan and a reference pan. First, as a blank measurement, a measurement is performed which has a program in which both the pans are kept empty at a constant temperature of 15° C. for 10 minutes, then heated to 115° C. at a rate of temperature rise of 10° C./min, and then kept at a constant temperature of 115° C. for 10 minutes. Then, about 10 mg of a synthetic sapphire having known specific heat at constant pressure is used for a reference material, and subjected to a measurement by the same program. Then, about 10 mg of a measurement sample (filler) in the same amount as the amount of the reference sapphire is set to the sample pan, and subjected to a measurement by the same program. The measurement results are analyzed using specific heat analyzing software attached to the differential scanning calorimeter, and the specific heat at constant pressure ($C_p$) at 25° C. is calculated from the arithmetic average value of the measurement results for 5 times.

True density (ρ): Dry automatic densimeter (trade name: Accupyc 1330-01; manufactured by Shimadzu Corporation)

Specifically, a 10 $cm^3$ specimen cell is used, and a sample (filler) is placed in the specimen cell in a volume of about 80% of the cell volume. After the weight of the sample is measured, the cell is set to a measurement portion in the apparatus and subjected to gas replacement using helium as a measurement gas 10 times, and then the volume is measured 10 times. The density (ρ) is calculated from the weight of the sample and the volume measured.

The filler can further contain vapor grown carbon fibers from the viewpoint of ensuring heat conductivity.

In FIG. 2, reference character 4*c* denotes the vapor grown carbon fibers described herein. The vapor grown carbon fibers are obtained by subjecting hydrocarbon and hydrogen as raw materials to a pyrolysis reaction in a gas phase in a heating furnace and growing the resultant to fibers by using catalyst fine particles as nuclei. The fiber diameter and the fiber length are controlled by the types, sizes and compositions of the raw materials and the catalyst, as well as the reaction temperature, atmospheric pressure and time, and the like, and fibers having a graphite structure further developed by a heat treatment after the reaction are known.

The fibers have a plural-layer structure in the diameter direction, and have a shape in which graphite structures are stacked in the tubular form. The fibers generally have an average fiber diameter of about 80 to 200 nm and an average fiber length of about 5 to 15 μm, and are commercially available.

Herein, the measurement method of the average fiber diameter and the average fiber length of the vapor grown carbon fibers in the elastic layer is as follows. That is, 10 g of a sample cut out from the elastic layer is first placed in a crucible, and heated in air at 550° C. for 8 hours to ash the rubber component for removal. Then, 1000 fibers are randomly selected from the vapor grown carbon fibers remaining in the crucible, and observed at a magnification of ×120 by using an optical microscope to measure the fiber lengths and the fiber diameters at fiber ends of the selected fibers by using digital image measurement software ((trade name: Quick Grain Standard, manufactured by Innotech Corporation). Then, the arithmetic average values of the fiber lengths and the fiber diameters are each defined as the average fiber length and the average fiber diameter.

Carbon black may be added as other filler for the purpose of imparting characteristics such as conductivity.

(3-2-2) Content

The total amount of the filler contained in the elastic layer 4 can be in a range of 25% by volume or more and 50% by volume or less on volume basis in order to not only ensure the flexibility of the elastic layer but also sufficiently achieve the heat conducting characteristic of the elastic layer. In particular, the total amount of the vapor grown carbon fibers contained can be 0.5% by volume or more and 5% by volume or less based on the volume of the elastic layer in order to suppress the increase in viscosity of the base material and maintain good processability in the case of a large amount of the fibers added.

(3-3) Thickness of Elastic Layer

The thickness of the elastic layer can be appropriately designed from the viewpoints of contributing to the surface hardness of the fixing member and ensuring the nip width. When the fixing member has a belt shape, the thickness of the elastic layer is preferably in a range of 100 μm or more and 500 μm or less and further preferably 200 μm or more and 400 μm or less because when the fixing member is incorporated to the fixing apparatus, the nip width can be ensured by deformation of the substrate, and the belt has a heat generation source. When the fixing member has a roller shape, it is necessary that the substrate be a rigid substrate and the nip width be formed by deformation of the elastic layer. Therefore, the thickness of the elastic layer is preferably in a range of 300 μm or more and 10 mm or less, and further preferably 1 mm or more and 5 mm or less. In the case, the configuration illustrated above is required to be adopted in the elastic layer region included within the range from the surface of the member to the thermal diffusion length μ.

(3-4) Production Method of Elastic Layer

As the production method of the elastic layer, a mold forming method, and processing methods such as a blade coating method, a nozzle coating method and a ring coating method, in Japanese Patent Application Laid-Open No. 2001-62380, in Japanese Patent Application Laid-Open No. 2002-213432 and the like, are widely known. Any of such methods can be used to heat and crosslink an admixture carried on the substrate, thereby forming the elastic layer.

Figure 3:
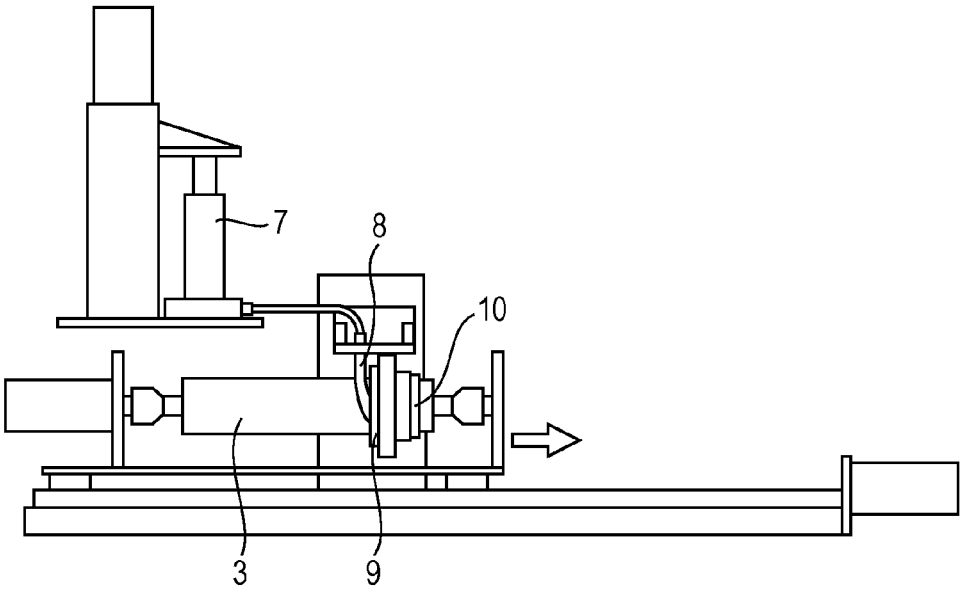
FIG. 3 is an illustrative view of one example of a step of forming an elastic layer of the fixing member according to the present invention.

FIG. 3 illustrates one example of a step of forming the elastic layer 4 on the substrate 3, and is a schematic view for describing a method using a so-called ring coating method.

Each filler is weighed, and compounded in an uncrosslinked base material (in the present example, addition-curing type silicone rubber), the resultant is sufficiently mixed and defoamed using a planetary universal mixer or the like to provide a raw material admixture for elastic layer formation, and the raw material admixture is filled in a cylinder pump 7 and pressure-fed to be applied to the periphery of the substrate 3 from a coating head 9 through a supply nozzle 8 of the raw material admixture.

The substrate 3 is allowed to move toward the right direction of the drawing at a predetermined speed at the same time as the application, thereby enabling a coat of the raw material admixture to be formed on the periphery of the substrate 3. The thickness of the coat can be controlled by a clearance between the coating head 9 and the substrate 3, the supply speed of the raw material admixture, the movement speed of the substrate 3, and the like. The coat 10 of the raw material admixture, formed on the substrate 3, is heated by a heating unit such as an electric furnace for a given period of time to allow a crosslinking reaction to progress, thereby enabling the elastic layer 4 to be formed.

(4) Releasing Layer and Production Method of Same

As the releasing layer 6, mainly a fluororesin layer, for example, exemplary resins listed below are used:

tetrafluoroethylene-perfluoro(alkyl vinyl ether) copolymer (PFA), polytetrafluoroethylene (PTFE), tetrafluoroethylene-hexafluoropropylene copolymer (FEP) or the like.

Among the exemplary materials listed above, PFA can be used from the viewpoints of formability and toner releasing property.

The forming measure is not particularly limited, but a method for covering with a tubular formed article, a method including coating the surface of the elastic layer with fluororesin fine particles directly or with a coating material having fluororesin fine particles dispersed in a solvent, and drying and melting the resultant for baking, and the like are known.

The releasing layer may also contain a filler for the purpose of controlling thermophysical properties as long as formability and releasing property are not impaired.

The thickness of the fluororesin releasing layer is preferably 50 μm or less, and further preferably 30 μm or less. The thickness within such a range enables maintaining the elasticity of the elastic layer stacked, suppressing the excessive increase in surface hardness of the fixing member.

(4-1) Releasing Layer Formation by Covering with Fluororesin Tube

A fluororesin tube can be prepared by a common method when a heat-melting fluororesin such as PFA is used. For example, a heat-melting fluororesin pellet is formed into a film by using an extrusion molding machine.

The inside of the fluororesin tube can be subjected to a sodium treatment, an excimer laser treatment, an ammonia treatment or the like in advance to thereby activate the surface and enhance adhesiveness.

Figure 4:
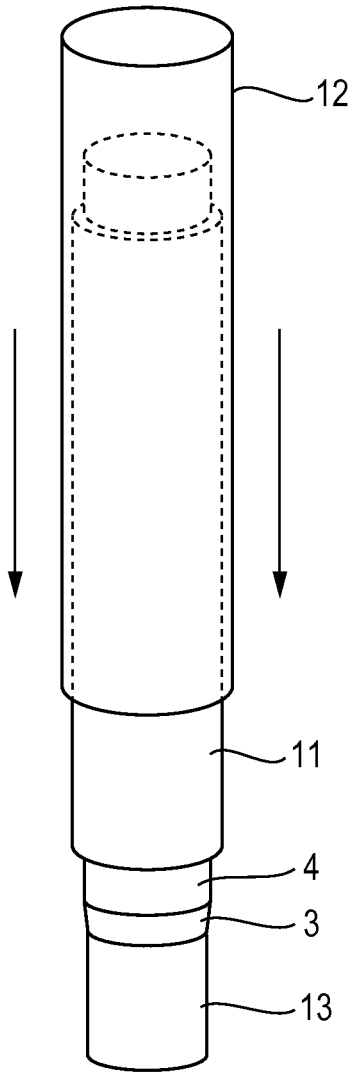
FIG. 4 is an illustrative view of one example of a step of forming a releasing layer of the fixing member according to the present invention.

FIG. 4 is a schematic view of one example of a step of stacking a fluororesin layer on the elastic layer 4 via an adhesive 11. The adhesive 11 is applied to the surface of the elastic layer 4 described above. The adhesive will be described later in detail. Before the application of the adhesive 11, the surface of the elastic layer 4 may also be subjected to an ultraviolet irradiation step. Thus, penetration of the adhesive 11 to the elastic layer 4 can be suppressed, and the increase in surface hardness due to the reaction of the adhesive 11 with the elastic layer can be suppressed. By performing the ultraviolet irradiation step under a heating environment, the step can be further effectively performed.

The outer surface of the adhesive 11 is covered with a fluororesin tube 12 as the releasing layer 6 for stacking.

When the substrate 3 is a shape-retainable core, no core cylinder is required, but when a thin substrate such as a resin belt or a metal sleeve for use in the belt-shaped fixing member is used, the substrate is externally fitted to a core cylinder 13 and held in order to prevent deformation at the time of processing.

The covering method is not particularly limited, but a covering method in which an adhesive is used as a lubricant, or a covering method in which a fluororesin tube is expanded from the outside can be used.

After the covering, a unit not illustrated is used to squeeze out the excessive adhesive remaining between the elastic layer and the releasing layer for removal. After the squeezing out, the thickness of an adhesive layer can be 20 μm or less. The thickness of the adhesive layer can be 20 μm or less to thereby more reliably suppress the reduction in heat conducting characteristic.

Then, the adhesive layer can be heated in a heating unit such as an electric furnace for a given period of time to thereby cure and bond the adhesive, and both ends thereof are if necessary processed so as to provide the desired length, thereby enabling to provide the fixing member of the present invention.

(4-1-1) Adhesive

The adhesive can be appropriately selected depending on the materials of the elastic layer and the releasing layer. However, when an addition-curing type silicone rubber is used for the elastic layer, an addition-curing type silicone rubber in which a self-adhesive component is compounded can be used as the adhesive 11. Specifically, the addition-curing type silicone rubber contains an organopolysiloxane having an unsaturated hydrocarbon group typified by a vinyl group, hydrogen organopolysiloxane, and a platinum compound as a crosslinking catalyst. Then, the addition-curing type silicone rubber is cured by an addition reaction. As such an adhesive, a known adhesive can be used.

Examples of the self-adhesive component include the following:

silane having at least one, preferably two or more functional groups selected from the group consisting of an alkenyl group such as a vinyl group, a (meth)acryloxy group, a hydrosilyl group (SiH group), an epoxy group, an alkoxysilyl group, a carbonyl group and a phenyl group;

organosilicon compound such as cyclic or linear siloxane having 2 or more and 30 or less silicon atoms, preferably 4 or more and 20 or less silicon atoms; and non-silicon (namely, containing no silicon atom in a molecule) organic compound optionally containing an oxygen atom in a molecule, which contains one or more and four or less, preferably one or more and two or less aromatic rings that are monovalent or higher and tetravalent or lower, preferably divalent or higher and tetravalent or lower, such as a phenylene structure, in one molecule, and contains at least one, preferably two or more and four or less functional groups that can contribute to a hydrosilylation addition reaction (for example, an alkenyl group and a (meth)acryloxy group) in one molecule.

The self-adhesive component can be used singly or in combination of two or more thereof.

A filler component can be added to the adhesive from the viewpoints of viscosity adjustment and ensuring heat resistance, as long as the filler component falls within the spirit of the present invention.

Examples of the filler component include the following:

silica, alumina, iron oxide, cerium oxide, cerium hydroxide, carbon black and the like.

Such an addition-curing type silicone rubber adhesive is also commercially available and can be easily obtained.

In addition, the vapor grown carbon fibers can be further added as the filler from the viewpoint of imparting heat conducting characteristic to the adhesive layer. The amount of the fibers added can be 0.5% by volume or more and 10% by volume or less in a volume percent in the adhesive layer from the viewpoint of maintaining adhesive strength.

(4-2) Releasing Layer Formation by Fluororesin Coating

For coating processing of the fluororesin as the releasing layer, a method such as an electrostatic coating method of fluororesin fine particles or spray coating of a fluororesin coating material can be used.

When an electrostatic coating method is used, electrostatic coating of fluororesin fine particles is first applied to the inner surface of a mold, and the mold is heated to a temperature equal to or higher than the melting point of the fluororesin, thereby forming a thin film of the fluororesin on the inner surface of the mold. Thereafter, the inner surface is subjected to an adhesive treatment and then a substrate is inserted, an elastic layer material is injected and cured between the substrate and the fluororesin, and then a molded article is released together with the fluororesin to enable to provide the fixing member of the present invention.

Figure 5:
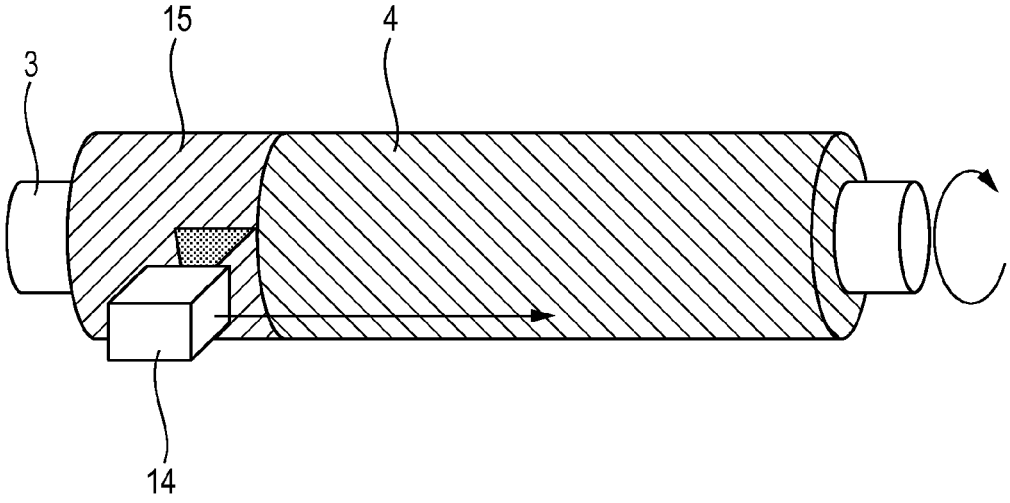
FIG. 5 is an illustrative view of one example of a step of forming a releasing layer of the fixing member according to the present invention.

When spray coating is used, a fluororesin coating material is used. FIG. 5 illustrates a schematic view of a spray coating method. The fluororesin coating material forms a so-called dispersion liquid in which fluororesin fine particles are dispersed in a solvent by a surfactant or the like. The fluororesin dispersion liquid is also commercially available and can be easily obtained. The dispersion liquid is supplied to a spray gun 14 by a unit non-illustrated, and misty sprayed by pressure of gas such as air. A member having the elastic layer 4 if necessary subjected to an adhesive treatment with a primer or the like is disposed at an opposite position to the spray gun, and the member is rotated at a given speed and the spray gun 14 is moved parallel with the axis direction of the substrate 3. Thus, a coat 15 of the fluororesin coating material can be evenly formed on the surface of the elastic layer. The member on which the coat 15 of the fluororesin coating material is thus formed is heated to a temperature equal to or higher than the melting point of the fluororesin coating material film by using a heating unit such as an electric furnace, thereby enabling a fluororesin releasing layer to be formed.

(5) Type C Micro Hardness of Fixing Member Surface

The deformation of the fixing member can be measured as a hardness in a large deformation region demanded in order to form a nip portion in the case of a fixing roller or the like, or a hardness in an infinitesimal deformation region demanded for following irregularities of fibers of paper as a member to be recorded, and a toner image. Herein, the hardness in an infinitesimal deformation region is focused and described.

The fixing member is required to be subjected to heat supply by following and being in contact with irregularities of paper fibers and a toner image, in order to impart a sufficient amount of heat for melting to a toner infiltrated into the interior of paper fibers and a toner image having a different stacking configuration depending on a section. When the following properties are compared, the hardness measured in an infinitesimal deformation region, so-called micro hardness, is known to be useful.

The type C micro hardness of the fixing member surface can be measured by using a micro rubber hardness tester (manufactured by Kobunshi Keiki Co., Ltd., trade name: micro rubber hardness tester MD-1 capa Type C). The micro hardness of the fixing member surface here is preferably 85 degrees or less, and particularly preferably 80 degrees or less.

In general, when a large amount of the filler is added in the elastic layer for the increase in heat efficiency, the hardness tends to be increased, but the flexibility of the elastic layer can be kept with heat efficiency being increased, by using the above method. By setting the Type C micro hardness within the range of the numerical values, excessive compression of an unfixed toner on a transfer medium can be suppressed. As a result, a high-quality electrophotographic image with little image displacement and bleeding can be obtained.

(6) Thermal Effusivity in Fixing Member of Multilayer Configuration

As described above, the fixing member has a multilayer configuration having the substrate, the elastic layer and the releasing layer. The fixing member supplies heat to a member to be heated from the releasing layer directly in contact with the member to be heated, and thus the ability to supply heat is determined by the thermal effusivity measured in a region of a time corresponding to the dwell time from the surface side.

The thermal diffusion length of a material having an alternating-current temperature wave of a certain frequency can be generally calculated by the expression (1) indicated above, but when the layer thickness is smaller than the thermal diffusion length, the temperature wave penetrates through the layer and has a heat influence on a layer located at a deeper position. Since the thermal diffusion length in a lower layer here is again changed by the thermophysical properties of the layer, recalculation is needed.

A fixing member having a multilayer (three or more layer) configuration is supposedly examined. When the thickness and the thermal diffusivity of the first layer are designated as $t_1$ and $\alpha_1$, respectively, and the thickness and the thermal diffusivity of the second layer are designated as $t_2$ and $\alpha_2$, respectively, the thermal diffusion length $\mu$ when the frequency f of the alternating-current temperature wave is applied to the surface of the first layer is examined. First, the thermal diffusion length $\mu_1$ of the first layer singly is expressed by $\mu_1=(\alpha_1/(\pi\cdot f))^{0.5}$. When $\mu_1 \leq t_1$ is here satisfied, the amplitude of the temperature wave attenuates only by the first layer, and thus the thermal diffusion length $\mu$ of the member is expressed by $\mu=\mu_1$.

However, when $\mu_1>t_1$ is satisfied, the heat influence of the temperature wave penetrates through the first layer and reaches the second layer. When the temperature wave that passes through the first layer and reaches the second layer is here expressed by a frequency conversion $f_2$, $f_2=\alpha_1/(\pi\cdot(\mu_1-t_1)^2)$ is derived by transformation of the expression 1.

In other words, when $\mu_1<t_1$ is satisfied, the state equivalent to application of an alternating-current temperature wave of frequency $f_2$ to the second layer singly is supposed. When such $f_2$ is used to likewise calculate the thermal diffusion length $\mu_2$ of the second layer, $\mu_2=(\alpha 2/(\pi \cdot f_2))^{0.5}$ is derived. When $\mu_2 \leq t_2$ is here satisfied, the temperature wave attenuates in the second layer and thus the thermal diffusion length $\mu$ of the member is expressed by $\mu=t_1+\mu_2$. However, when $\mu_2>t_2$ is satisfied, the temperature wave reaches the third layer located at a further deeper position, and thus the same calculation is required to be performed in order to derive the thermal diffusion length of the member.

Then, the average thermal effusivity $b_f$ in the depth region corresponding to the thermal diffusion length $\mu_f$, when an alternating-current temperature wave of frequency f is applied to the fixing member having a multilayer configuration, is discussed.

The thermal effusivity in each of the layers can be derived from the values of the thermophysical properties of each of the layers by expression 2. Herein, when the thermal effusivity of the first layer is designated as $b_1$ and the thermal effusivity of the second layer is designated as $b_2$ to determine $b_f$ from weighted average with the case where the temperature wave reaches the second layer and attenuates being supposed, $b_f=((b_1 \cdot t_1)/(t_1+\mu_2))+((b_2 \cdot \mu_2)/(t_1+\mu_2))$ is derived. Also when the temperature wave reaches the third or higher layer, the thermal effusivity $b_f$ can be derived in the same manner.

(6-1) Thermal Effusivity of Releasing Layer

The fluororesin is generally used for the releasing layer, and thus, when PFA having no filler incorporated is used, the thermal effusivity of the layer is about 0.6 to 0.8 [kJ/(m$^2$·K·sec$^{0.5}$)] by the thermophysical property values. In addition, the thermal effusivity can be enhanced by adding the filler. While an inorganic filler such as silicon carbide, boron nitride, zinc oxide, silica or alumina can be used as the filler, the filler is added in a large amount to result in such an adverse effect that releasing property and formability are deteriorated.

However, it has been confirmed that when the vapor grown carbon fibers are used for the filler, the filler is added even in a small amount to thereby enable the thermal effusivity to be significantly increased. Specifically, when the fluororesin releasing layer is formed in the state where the vapor grown carbon fibers are contained in 3% by volume in a volume ratio relative to PFA, the thermal effusivity increased about 1.5 to 2 times is achieved.

(6-2) Thermal Effusivity of Adhesive Layer

The addition-curing type silicone rubber adhesive can be used for the adhesive layer when the fluororesin tube releasing layer having a tubular shape is formed, as described above, but it is estimated that the filler is compounded also in the adhesive layer to result in the enhancement in thermal effusivity. While a common inorganic filler such as silicon carbide, boron nitride, zinc oxide, silica or alumina may be used, a large amount thereof is required for the enhancement in thermal effusivity, and thus the increase in viscosity is caused to make difficult thinly squeezing in a squeezing step after covering with the tube. However, it has been here confirmed that the vapor grown carbon fibers are added as the filler in a small amount to thereby result in the enhancement in thermal effusivity. Specifically, it can be confirmed that the vapor grown carbon fibers are added to the adhesive having a thermal effusivity of the adhesive layer singly of about 0.6 [kJ/(m$^2$·K·sec$^{0.5}$)] in 2% by volume in a volume percent to thereby increase the thermal effusivity to about 1.2 [kJ/(m$^2$·K·sec$^{0.5}$)].

(6-3) Thermal Effusivity of Elastic Layer

Since the elastic layer can ensure a relatively larger layer thickness than the releasing layer, the adhesive layer and the like, various fillers can be filled in the elastic layer for the purpose of the enhancement in thermophysical properties. However, it is necessary to ensure the flexibility as the fixing member, and thus the total amount of the fillers can be designed so as to be 50% or less in a volume percent. If the volume percent of the fillers exceeds 50%, the flexibility of the elastic layer may be deteriorated to cause the degradation in image quality of an electrophotographic image.

The present inventors have made intensive studies in order to enhance the thermal effusivity of the elastic layer under the conditions, and as a result, have been able to confirm that a filler having a high volume heat capacity and vapor grown carbon fibers are compounded together to thereby exert a synergetic effect as compared with the case of each being compounded singly.

Figure 9:
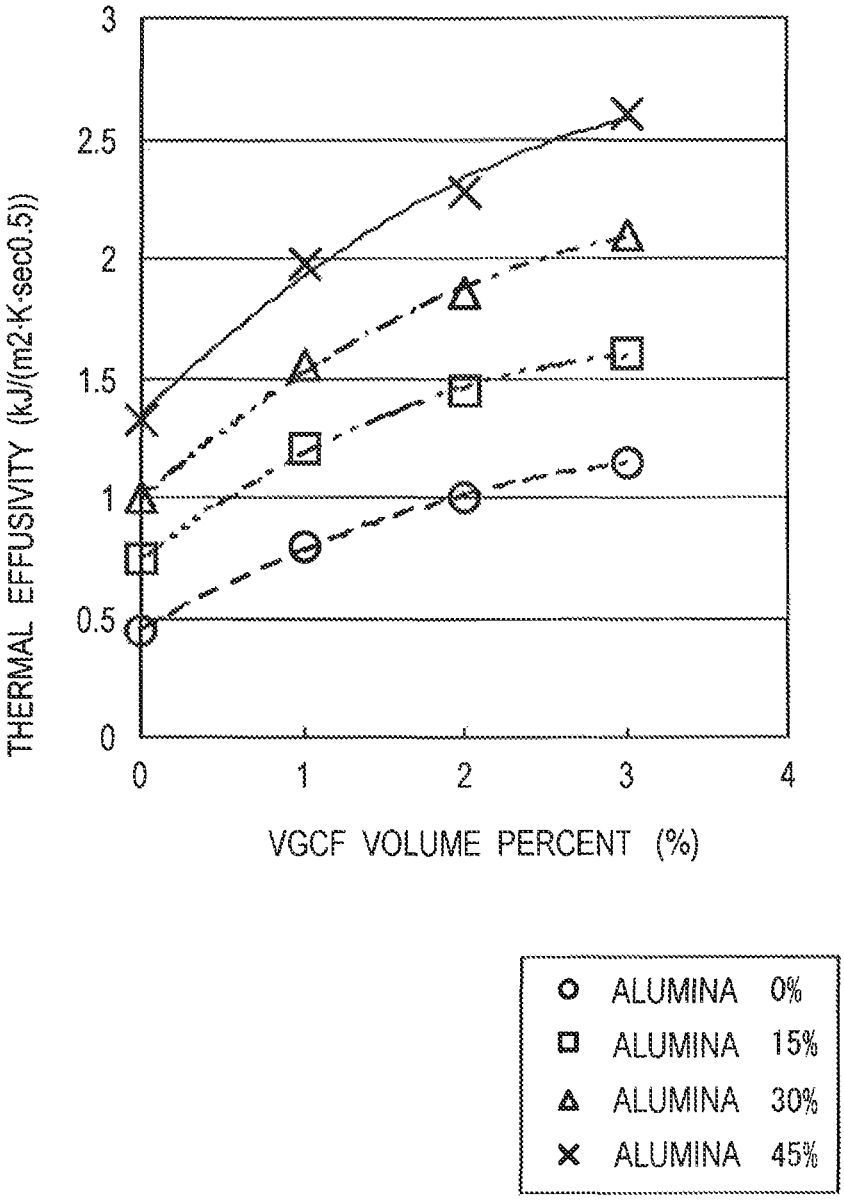
FIG. 9 is a graph representing a relationship between the amount of vapor grown carbon fibers compounded in the elastic layer and thermal effusivity.

A relationship between the amount of the vapor grown carbon fibers compounded and the thermal effusivity, when alumina as the filler having a high volume heat capacity and the vapor grown carbon fibers are compounded in a silicone rubber, is illustrated in FIG. 9.

It can be confirmed that the vapor grown carbon fibers and alumina as the filler having a high volume heat capacity are simultaneously compounded in the elastic layer to thereby exert the effect of more effectively increasing the thermal effusivity as compared with the case of each being compounded singly.

The reason why the effect is exerted cannot be yet sufficiently found out. However, the present inventors presume as follows. That is, it is considered that the state where the vapor grown carbon fibers are mutually entwined and bridged between the inorganic fillers having a high volume heat capacity uniformly dispersed in the elastic layer is formed to form a heat conducting path having a high heat conductivity in the elastic layer, thereby resulting in the increase in thermal effusivity.

Figure 10:
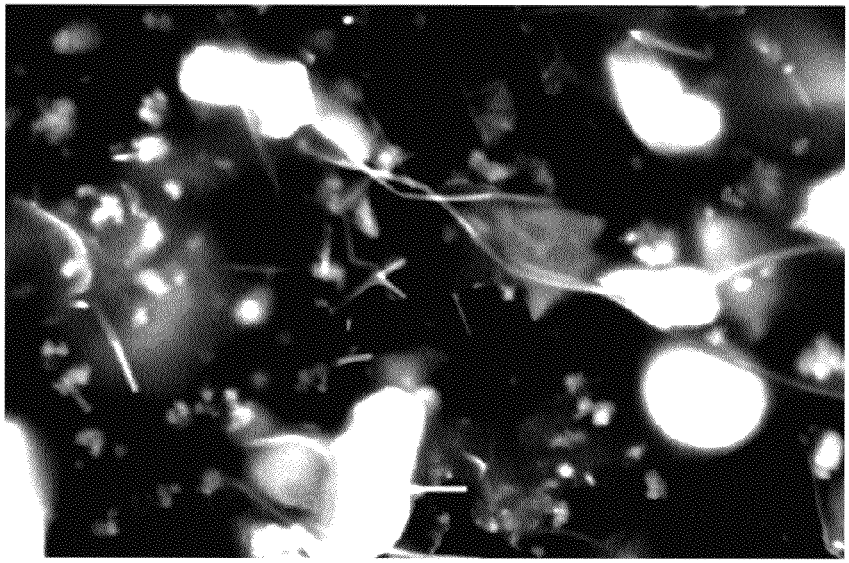
FIG. 10 is a scanning electron microscope (SEM) micrograph of a material of the elastic layer according to the present invention.

FIG. 10 illustrates a scanning electron microscope (SEM) micrograph of an elastic layer material obtained by compounding alumina and the vapor grown carbon fibers in the addition-curing type silicone rubber, and heating and curing the resultant. Alumina particles are observed as white solids and the vapor grown carbon fibers are observed as white fibers. It can be confirmed as indicated in the micrograph that the state where the vapor grown carbon fibers are bridged between the alumina particles is formed.

When the inorganic filler having a high volume heat capacity is compounded singly and the amount thereof compounded is small, it is difficult to form a heat conducting path as described above. In addition, when the vapor grown carbon fibers are compounded singly, the amount of heat accumulated in the same volume, so-called volume heat capacity is small even if the heat conducting path is formed. Therefore, it is difficult in both the cases to enhance the thermal effusivity.

(7) Fixing Apparatus

In an electrophotographic heat-fixing apparatus, rotation members such as a pair of a heated roller and a roller, a film and a roller, a belt and a roller, and a belt and a belt are in pressure-contact with each other, and are appropriately selected in consideration of conditions such as the process speed and the size of the electrophotographic image forming apparatus as a whole.

In the fixing apparatus, a heated fixing member and a pressure member are in pressure-contact with each other to thereby form a fixing nip width N, and a material to be recorded P serving as a member to be heated, on which an image is formed by an unfixed toner G, is conveyed through the fixing nip width N while being sandwiched. Thus, a toner image is heated and pressurized. As a result, the toner image is molten and colored, and then cooled to thereby be fixed on the material to be recorded. From a relationship of the nip width N with the conveyance velocity V of the material to be recorded at the time, N/V can be used to calculate a dwell time T that is a time at which the material to be recorded is retained in the fixing nip.

(7-1) Heat-Fixing Apparatus Using Belt-Shaped Fixing Member

Figure 6:
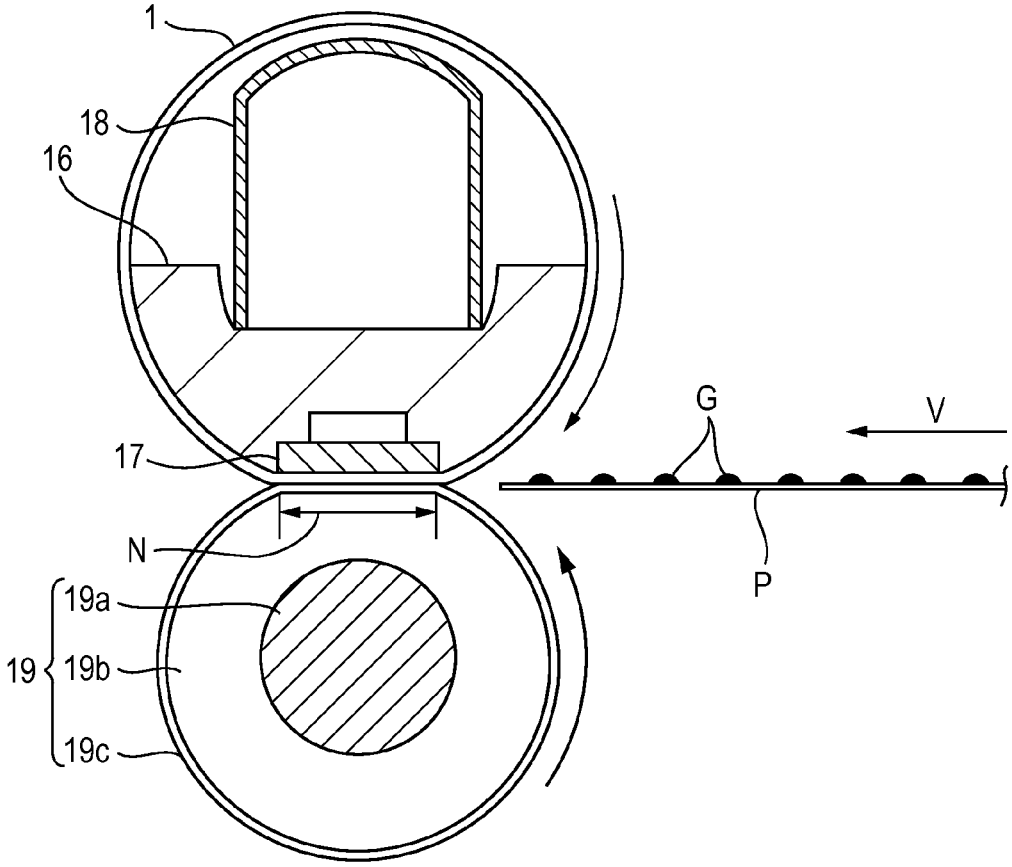
FIG. 6 is a cross-sectional view of one example of the fixing apparatus according to the present invention.

FIG. 6 illustrates a lateral cross-sectional schematic view of one example of a heat-fixing apparatus using the belt-shaped electrophotographic fixing member according to the present invention.

In the heat-fixing apparatus, reference numeral 1 denotes a seamless-shaped fixing belt, as a fixing member according to one embodiment of the present invention. In order to hold the fixing belt 1, a belt guide member 16 is formed which is shaped by a heat resistant and heat insulating resin. A ceramic heater 17 as a heat source is provided at a position where the belt guide member 16 and the inner surface of the fixing belt 1 are in contact with each other. The ceramic heater 17 is fitted in a groove portion shaped and provided along the longitudinal direction of the belt guide member 16, and immovably-supported. The ceramic heater 17 is electrified by a unit non-illustrated, to generate heat.

The seamless-shaped fixing belt 1 is externally fitted to the belt guide member 16 in a loose manner. A pressurizing rigid stay 18 is inserted in and passed through the inside of the belt guide member 16. An elastic pressure roller 19 as the pressure member is one in which an elastic layer 19*b* made of a silicone rubber is provided on a stainless core 19*a* to reduce surface hardness. Both ends of the core 19*a* are disposed while being rotatably held by bearing between plates (not illustrated) at the front side and at the back side as the chassis side against the apparatus. The elastic pressure roller 19 is covered with a fluororesin tube of 50 μm as a surface layer 19*c* in order to enhance surface property and releasing property.

Each pressure spring (not illustrated) is compressed and disposed between each of both ends of the pressurizing rigid stay 18 and a spring holding member (not illustrated) at the chassis side of the apparatus to thereby impart a depressing force to the pressurizing rigid stay 18. Thus, the lower surface of the ceramic heater 17 disposed on the lower surface of the belt guide member 16 and the upper surface of the pressure member 19 are in pressure-contact with each other while sandwiching the fixing belt 1, to form a predetermined fixing nip N. A material to be recorded P serving as a member to be heated, on which an image is formed by an unfixed toner G, is conveyed to the fixing nip N, while being sandwiched, at the conveyance velocity V. Thus, a toner image is heated and pressurized. As a result, the toner image is molten and colored, and then cooled to thereby be fixed on the material to be recorded.

(7-2) Heat-Fixing Apparatus Using Roller-Shaped Fixing Member

Figure 7:
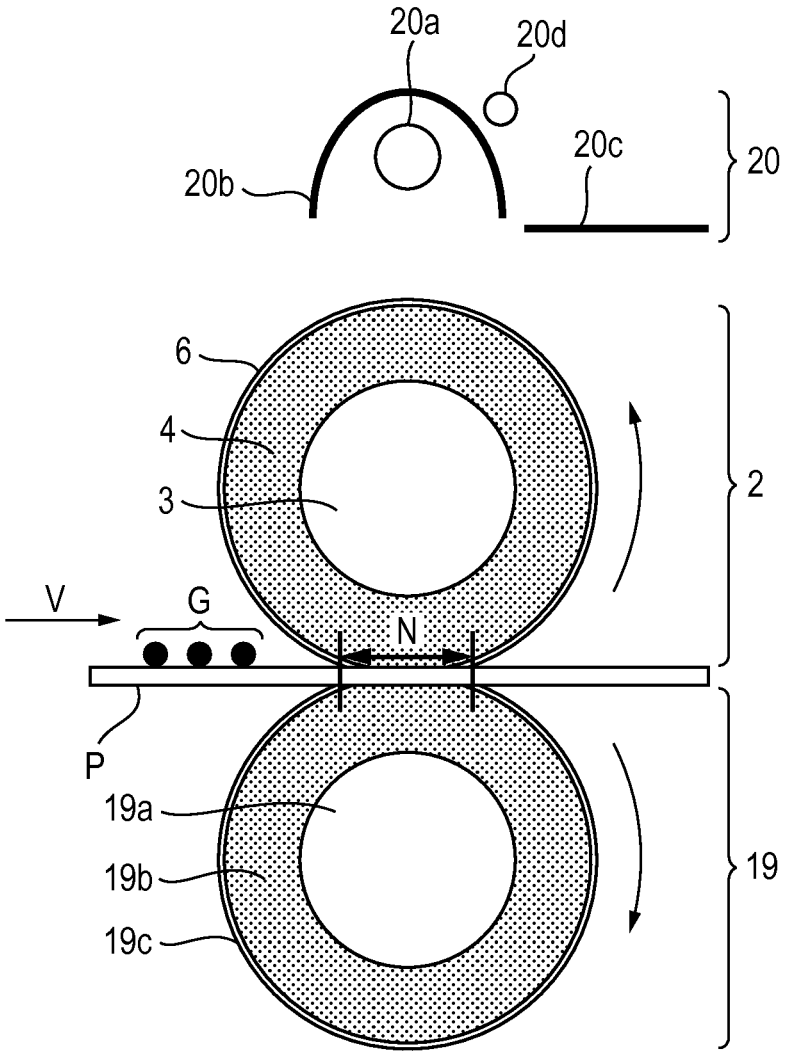
FIG. 7 is a cross-sectional view of one example of the fixing apparatus according to the present invention.

FIG. 7 illustrates a lateral cross-sectional schematic view of one example of a heat-fixing apparatus using the roller-shaped electrophotographic fixing member according to the present invention.

In the heat-fixing apparatus, reference numeral 2 denotes a fixing roller as a fixing member according to one embodiment of the present invention. In the fixing roller 2, an elastic layer 4 is formed on the outer periphery of a core 3 being a substrate, and a releasing layer 6 is further formed on the outer periphery of the elastic layer 4 by a coating method. In an elastic layer 4 in a range of 100 μm from the surface of the fixing roller 2, the thermophysical properties are imparted. In an elastic layer 4 in a range deeper than the above range, an elastic material having a high heat insulating property may be used so that the amount of heat imparted from an external heating unit 20 is not excessively accumulated.

A pressure roller 19 as the pressure member is oppositely disposed to the fixing roller 2, and the two rollers are rotatably pressed by a pressure unit non-illustrated, to thereby form a fixing nip N.

The external heating unit 20 heats the fixing roller 2 from the outside of the roller in a non-contact manner. The external heating unit 20 has a halogen heater (infrared source) 20*a* as a heat source, and a reflection mirror (infrared reflection member) 20*b* for effectively utilizing the radiation heat of the halogen heater 20*a*.

The halogen heater 20*a* is oppositely arranged to the fixing roller 2, and is electrified by a unit non-illustrated, to generate heat. Thus, the surface of the fixing roller 2 is directly heated. In addition, the reflection mirror 20*b* having high reflectance is also disposed in a direction other than the direction of the fixing roller 2 by the halogen heater 20*a*.

The reflection mirror 20*b* is provided, while being curved so as to project opposite to the fixing roller 2, so that the mirror receives the halogen heater 20*a* therein. Thus, the reflection mirror 20*b* can effectively reflect the radiation heat from the halogen heater 20*a* toward the fixing roller 2 without diffusing the radiation heat.

In the present embodiment, the reflection mirror 20*b* has a shape of an elliptical orbit in the paper-feeding direction, and is arranged so that one focal point is located near the halogen heater 20*a* and another focal point is located near the surface of the inside of the fixing roller 2. Thus, a light collection effect due to the elliptical shape can be utilized to collect reflected light in the vicinity of the surface of the fixing roller.

In addition, a shutter 20*c* and a temperature detection element 20*d* as temperature control units of the fixing roller 2 are provided, and such temperature control units and the halogen heater 20*a* are appropriately controlled by a unit non-illustrated, to thereby enable the surface temperature of the fixing roller 2 to be controlled in a substantially uniform manner.

In the fixing roller 2 and the pressure roller 19, a rotation force is transmitted by a unit non-illustrated through ends of the substrate 3 or 19*a* to control rotation so that the movement speed of the surface of the fixing roller 2 is substantially the same as the conveyance velocity V of a member to be recorded. In the case, the rotation force is imparted to any one of the fixing roller 2 and the pressure roller 19 and another one may be driven to be rotated, or the rotation force may be imparted to both of the rollers.

A material to be recorded P serving as a member to be heated, on which an image is formed by an unfixed toner G, is conveyed to the fixing nip N thus formed of the heat-fixing apparatus while being sandwiched. Thus, a toner image is heated and pressurized. As a result, the toner image is molten and colored, and then cooled to thereby be fixed on the material to be recorded.

(8) Electrophotographic Image Forming Apparatus

Figure 8:
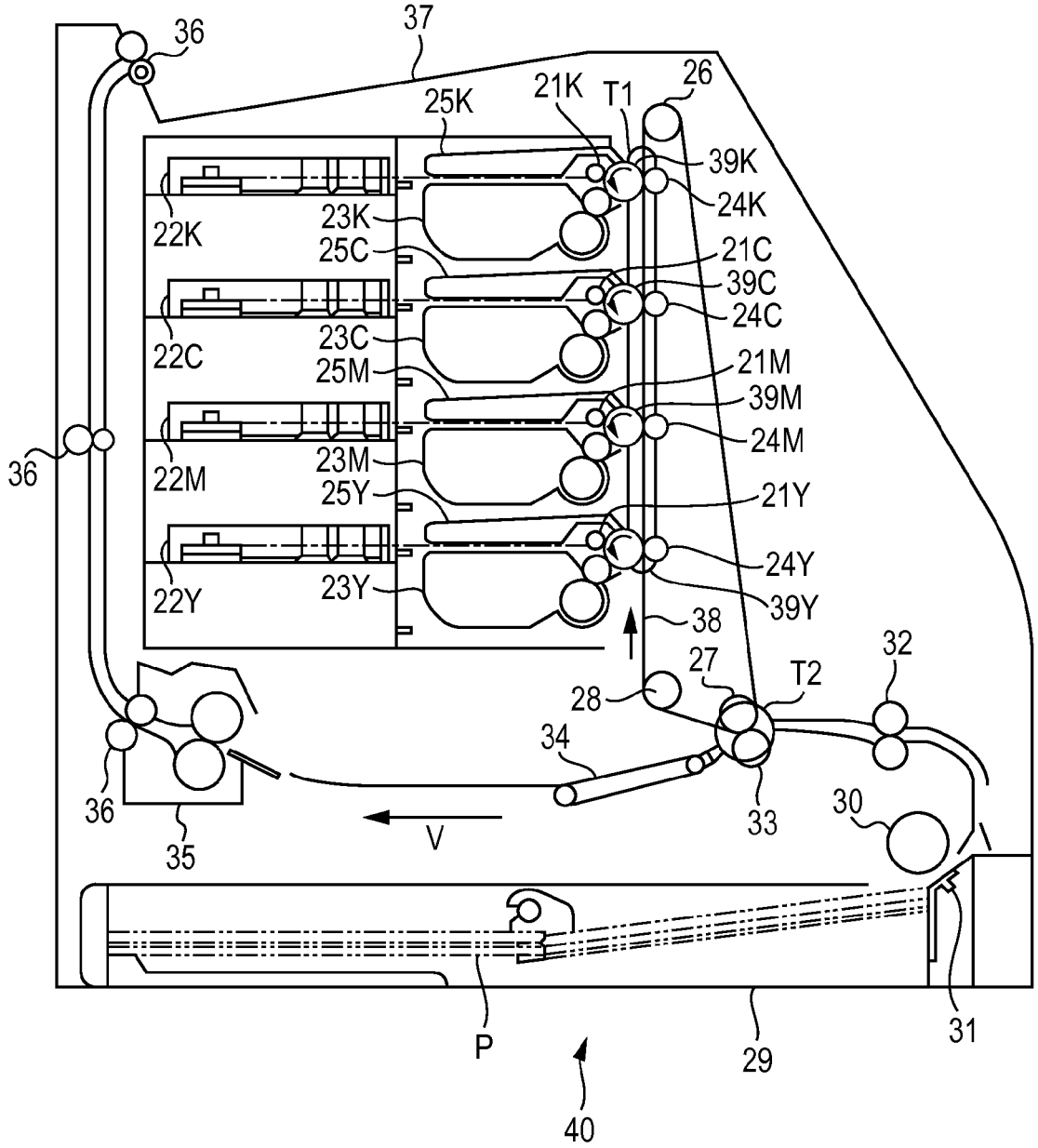
FIG. 8 is a cross-sectional view of one example of the electrophotographic image forming apparatus according to the present invention.

The entire configuration of the electrophotographic image forming apparatus is schematically described. FIG. 8 is a schematic cross-sectional view of a color laser printer according to the present embodiment.

A color laser printer (hereinafter, referred to as "printer") 40 illustrated in FIG. 8 has an image forming portion having an electrophotographic photosensitive drum (hereinafter, referred to as "photosensitive drum"), which is rotatable at a given speed, of each color of yellow (Y), magenta (M), cyan (C) and black (K). In addition, the printer has an intermediate transfer member 38 that retains a color image developed and multiple-transferred in the image forming portion and that further transfers the color image to a material to be recorded P fed from a feeding portion.

Photosensitive drums 39 (39Y, 39M, 39C, 39K) are rotatably driven by a driving unit (not illustrated) in a counterclockwise manner as illustrated in FIG. 8. The photosensitive drums 39 are provided with charging apparatuses 21 (21Y, 21M, 21C, 21K) for uniformly charging the surfaces of each of the photosensitive drums 39, scanner units 22 (22Y, 22M, 22C, 22K) for radiating a laser beam based on image information to form an electrostatic latent image on each of the photosensitive drums 39, developing units 23 (23Y, 23M, 23C, 23K) for attaching a toner to the electrostatic latent image to develop the latent image as a toner image, primary transfer rollers 24 (24Y, 24M, 24C, 24K) for transferring the toner image of each of the photosensitive drums 39 to the intermediate transfer member 38 by a primary transfer portion T1, and units 25 (25Y, 25M, 25C, 25K) having a cleaning blade to remove a transfer residue toner remaining on the surface of each of the photosensitive drums 39 after transfer, arranged on the circumferences thereof in this order in the rotation direction.

During image formation, a belt-shaped intermediate transfer member 38 extending over rollers 26, 27 and 28 is rotated, and the toner image of each color formed on each of the photosensitive drums is superimposed on the intermediate transfer member 38 and primary transferred to thereby form a color image.

The material to be recorded P is conveyed to a secondary transfer portion by a conveyance unit so as to be synchronized with the primary transferring to the intermediate transfer member 38. The conveyance unit has a feeding cassette 29 accommodating a plurality of the materials to be recorded P, a feeding roller 30, a separation pad 31 and a pair of resist rollers 32. During image formation, the feeding roller 30 is driven and rotated according to an image forming operation, and the materials to be recorded P in the feeding cassette 29 are separated one by one and conveyed to the secondary transfer portion by the pair of resist rollers 32 with being in time with the image forming operation.

A movable secondary transfer roller 33 is arranged in a secondary transfer portion T2. The secondary transfer roller 33 is movable in a substantially vertical direction. Then, the roller 33 is pressed on the intermediate transfer member 38 via the material to be recorded P at a predetermined pressure during image transferring. In the time, a bias is simultaneously applied to the secondary transfer roller 33 and the toner image on the intermediate transfer member 38 is transferred to the material to be recorded P.

Since the intermediate transfer member 38 and the secondary transfer roller 33 are separately driven, the material to be recorded P sandwiched therebetween is conveyed in a left arrow direction indicated in FIG. 8 at a predetermined conveyance velocity V, and further conveyed by a conveyance belt 34 to a fixing portion 35 as the next step. In the fixing portion 35, heat and pressure are applied to fix the transferred toner image to the material to be recorded P. The material to be recorded P is discharged on a discharge tray 37 on the upper surface of the apparatus by a pair of discharge rollers 36.

Then, the fixing apparatus according to the present invention illustrated in FIG. 6 or FIG. 7 can be applied to the fixing portion 35 of the electrophotographic image forming apparatus illustrated in FIG. 8 to thereby provide an electrophotographic image forming apparatus capable of providing a high-quality electrophotographic image with consumption energy being suppressed.

EXAMPLES

Hereinafter, the present invention will be more specifically described using Examples.

Example A-1

A high-purity truly spherical alumina (trade name: Alunabeads CB-A25BC; produced by Showa Titanium Co., Ltd.) as a filler was compounded with a commercially available addition-curing type silicone rubber stock solution (trade name: SE1886; "A-liquid" and "B-liquid" produced by Dow Corning Toray Co., Ltd. were mixed in equal amounts) in 35% by volume in a volume ratio based on a cured silicone rubber layer, and kneaded. Thereafter, vapor grown carbon fibers (trade name: carbon nanofiber • VGCF-S; produced by Showa Denko K. K.) as a filler were further added in 2% by volume in a volume ratio, and kneaded to provide a silicone rubber admixture.

Herein, the volume heat capacity ($C_p \cdot \rho$) of each of the fillers is as follows. Each physical property value was measured in a room temperature environment of 25° C.

Alunabeads CB-A25BC: 3.03 [$mJ/m^3 \cdot K$]

Carbon nanofiber • VGCF-S: 3.24 [$mJ/m^3 \cdot K$]

As a substrate, a nickel-plated, endless-shaped sleeve whose surface was subjected to a primer treatment, having an inner diameter of 30 mm, a width of 400 mm and a thickness of 40 μm, was prepared. Herein, in a series of production steps, the sleeve was handled while the core cylinder 13 illustrated in FIG. 4 being inserted therein.

The substrate was coated with the silicone rubber admixture by a ring coating method so that the thickness was 300 μm. The sleeve having a coat of the silicone rubber admixture formed on the surface thereof was heated in an electric furnace set at 200° C. for 4 hours to cure the coat of the silicone rubber admixture, forming an elastic layer. The thermophysical property values of the elastic layer can be measured by the following apparatus. Each physical property value was measured in a room temperature environment of 25° C. The resulting thermophysical property values can be used to calculate the thermal effusivity b1 of the single elastic layer part by using (expression 2). As a result, the thermal effusivity b1 of the elastic layer was 1.97 [$kJ/(m^2 \cdot K \cdot sec^{0.5})$]. The result is shown in Table 5-1.

Specific heat at constant pressure ($C_p$): Differential scanning calorimeter (trade name: DSC823e; manufactured by Mettler-Toledo International Inc.);

The measurement was performed according to JIS K 7123 "Testing methods for specific heat capacity of plastics". An aluminum pan was used as each of a sample pan and a reference pan. First, as a blank measurement, a measurement was performed which had a program in which both the pans were kept empty at a constant temperature of 15° C. for 10 minutes, then heated to 115° C. at a rate of temperature rise of 10° C./min, and then kept at a constant temperature of 115° C. for 10 minutes. Then, about 10 mg of a synthetic sapphire having known specific heat at constant pressure was used for a reference material, and subjected to a measurement by the same program. Then, about 10 mg of a measurement sample in the same amount as the amount of the reference sapphire was set to the sample pan, and subjected to a measurement by the same program. The measurement results were analyzed using a specific heat analyzing software attached to the differential scanning calorimeter, and the specific heat at constant pressure ($C_p$) at 25° C. was calculated from the arithmetic average value of the measurement results for 5 times.

Density (ρ): Dry automatic densimeter (trade name: Accupyc 1330-01; manufactured by Shimadzu Corporation); A 10 $cm^3$ specimen cell was used, and a sample was placed in the specimen cell in a volume of about 80% of the cell volume. After the weight of the specimen was measured, the cell was set to a measurement portion in the apparatus and subjected to gas replacement using helium as a measurement gas 10 times, and then the volume was measured 10 times. The density (ρ) was calculated from the weight of the specimen and the volume measured.

Heat conductivity (λ): periodic heating method-thermophysical property measurement apparatus (trade name: FTC-1; manufactured by Ulvac-Riko, Inc.);

The sample was cut out so as to have an area of 8×12 mm for preparation, and set to a measurement portion of the apparatus to measure thermal diffusivity (α). From the thermal diffusivity (α) obtained from the arithmetic average value of the measurement for 5 times, and the specific heat at constant pressure ($C_p$) and the density (ρ) determined above, the heat conductivity (λ) was calculated according to a relationship of $\lambda=\alpha\cdot C_p\cdot\rho$.

While the surface of the sleeve, on which the elastic layer was formed, being rotated at a movement speed of 20 mm/sec in the circumferential direction, an ultraviolet lamp placed at a distance of 10 mm from the surface was used to irradiate the elastic layer with ultraviolet ray. A low pressure mercury ultraviolet lamp (trade name: GLQ500US/11; manufactured by Harrison Toshiba Lighting Co. Ltd.) was used for the ultraviolet lamp to perform irradiation at 100° C. for 5 minutes in an air atmosphere.

After being cooled to room temperature, the surface of the elastic layer on the sleeve was coated with an addition-curing type silicone rubber adhesive (trade name: SE1819CV; "A-liquid" and "B-liquid" produced by Dow Corning Toray Co., Ltd. were mixed in equal amounts) in a substantially uniform manner so that the thickness was about 20 μm.

Then, a fluororesin tube (trade name: KURANFLON-LT; produced by Kurabo Industries Ltd.) having an inner diameter of 29 mm and a thickness of 10 μm was stacked as illustrated in FIG. 4. Thereafter, the surface was uniformly squeezed from the top of the fluororesin tube, and thus an excessive adhesive was squeezed out from a space between the elastic layer and the fluororesin tube so that the tube was sufficiently thinned.

Herein, the fluororesin tube was produced by subjecting a PFA resin pellet (trade name: PFA451HPJ; produced by Du Pont-Mitsui Fluorochemicals Co., Ltd.) to extrusion molding using an extrusion molding machine to form a tube.

Then, the sleeve was heated in an electric furnace set at 200° C. for 1 hour to thereby cure an adhesive, securing the fluororesin tube on the elastic layer. Both ends of the resulting sleeve were cut to provide a fixing belt having a width of 341 mm.

The cross-section of the resulting fixing belt was observed by a microscope, and the thickness of an adhesive layer was 5 μm.

The thermal effusivity b3 of the single fluororesin tube releasing layer used here was calculated to be 0.71 [kJ/($m^2\cdot K\cdot sec^{0.5}$)] from the measurement values of thermophysical properties, and the thermal effusivity b2 of the single adhesive layer was calculated to be 0.61 [kJ/($m^2\cdot K\cdot sec^{0.5}$)]. The results are shown in Table 6-1.

A test piece of 20 mm×20 mm for thermophysical property measurement was cut out from ends cut from the fixing belt. After a molybdenum (Mo) thin film (thickness: 100 nm) was formed on the surface on the releasing layer, of the test piece, by sputtering, the test piece was placed on a specimen stage of a light heating thermoreflectance method-thermophysical property microscope (trade name: Thermal Microscope; manufactured by Bethel Co., Ltd.).

The AC frequency f of a alternating-current temperature wave of a heating laser was sequentially changed to 10 Hz, 20 Hz, 33 Hz and 50 Hz and applied to the (outer) surface of the releasing layer of the test piece to measure the thermal effusivity. As a result, the thermal effusivities $b_f$ (hereinafter, the thermal effusivities of the respective frequencies are also designated as $b_{10}$, $b_{20}$, $b_{33}$ and $b_{50}$) were each as follows: $b_{10}$=1.83, $b_{20}$=1.76, $b_{33}$=1.67 and $b_{50}$=1.57 [kJ/($m^2\cdot K\cdot sec^{0.5}$)]. The measurement value was an average value of results at 25 points in a measurement area of 2 mm square. In addition, the thermal diffusion lengths μ at the respective AC frequencies (hereinafter, the thermal diffusion lengths of the respective frequencies are also designated as $\mu_{10}$, $\mu_{20}$, $\mu_{33}$ and $\mu_{50}$) were calculated in terms of the physical property values and the layer configuration and were each as follows: $\mu_{10}$=140.5 μm, $\mu_{20}$=91.5 μm, $\mu_{33}$=64.8 μm and $\mu_{50}$=48.0 μm.

The surface hardness of the resulting fixing belt was measured for 12 points in total of 4 points in the circumferential direction×3 points in the longitudinal direction by using a Type C micro hardness tester (trade name: MD-1 capa Type C; manufactured by Kobunshi Keiki Co., Ltd.). As a result, the average surface micro hardness was 76 degrees. The foregoing results are shown in Table 7-1.

The fixing belt was mounted to a fixing apparatus unit of a color laser printer (trade name: Satera LBP5900; manufactured by Canon Inc.) as illustrated in FIG. 6, and pressure-sensitive paper was nipped to measure a nip width, and the nip width was 9.0 mm.

In the fixing apparatus unit, a rotation driving force was applied to the pressure roller in an arrow direction so that the paper-feeding speed was 90 mm/sec, and a ceramic heater was electrified under control to thereby perform temperature regulation control so that the surface temperature of the fixing belt was 185° C. Thus, a member to be recorded was allowed to pass through a fixing nip portion in an environment of a dwell time T of 100 msec.

A4 size printing paper (trade name: Office Planner, manufactured by Canon Inc., thickness: 95 μm, basis weight: 68 $g/m^2$) was prepared. The paper, on which a K type (chromel-alumel type) thermocouple having a diameter of 25 μm was pasted by a heat-resistant polyimide tape so that the tip of an element exposed was located at a position of 20 mm from the tip part of the surface of the paper in the conveyance direction, (hereinafter, referred to as temperature evaluation paper), was prepared. While both ends of the thermocouple were connected to a commercially available temperature measurement apparatus, the temperature evaluation paper was introduced to the nip portion of the fixing apparatus unit prepared in advance so that the thermocouple was located at the fixing member side, and the detection temperature in the thermocouple was measured to evaluate ability to supply heat. As a result, the maximum temperature in the thermocouple, confirmed by the temperature measurement apparatus, was 166° C. The results are shown in Table 8.

Then, when the temperature evaluation paper was fed under the same surface condition of 185° C. while the paper-feeding speed was set to 180 mm/sec and the dwell time T was set to 50 msec, the maximum temperature detected in the thermocouple was 157° C.

With respect to the case where the same manner was performed while the paper-feeding speed was set to 300 mm/sec and the dwell time was set to 30 msec as well as the case where the same manner was performed while the paper-feeding speed was set to 450 mm/sec and the dwell time was set to 20 msec, the temperature evaluation paper was used for temperature measurement. As a result, the detection temperatures were 145° C and 126° C, respectively. The foregoing results are shown in Table 8.

In addition, the fixing belt was mounted to a fixing apparatus unit of a color laser printer (trade name: Satera LBP5900; manufactured by Canon Inc.) as illustrated in FIG. 6, an electrophotographic image was formed, and the gloss unevenness of the resulting electrophotographic image was evaluated. The gloss unevenness of the electrophotographic image depends on the following performance of a member to be recorded to a fiber structure, and deteriorates as the increase in surface hardness of the fixing belt. In other words, the gloss unevenness of the electrophotographic image can be an index of an influence of the surface hardness of the fixing belt on the quality of the electrophotographic image.

An evaluation image was formed by A4 size printing paper (trade name: Office Planner, manufactured by Canon Inc., thickness: 95 μm, basis weight: 68 g/m$^2$) with a cyan toner and a magenta toner being almost entirely applied in a density of 100%. The resultant was taken as an evaluation image, and visually observed to evaluate the gloss unevenness. As a result, an extremely high-quality electrophotographic image with less gloss unevenness was obtained.

(Example A-2) to (Example A-12) and (Comparative Example A-1) to (Comparative Example A-10)

The type and the amount of the filler in the silicone rubber admixture, and the thickness of the fluororesin tube were changed as listed in Table 5-1 and Table 6-1. Each of fixing belts was prepared in the same manner as in Example A-1 except for such changes, and the thermophysical properties and the surface hardness were evaluated. The thermal effusivity b1 of each of elastic layers was listed in Table 5-1, and the thermal effusivity b2 of each of adhesive layers and the thermal effusivity b3 of each of releasing layers were listed in Table 6-1. In addition, the thermal effusivities $b_{10}$, $b_{20}$ and $b_{33}$ of the temperature frequencies (10 Hz, 20 Hz, 33 Hz) of each of the fixing belts and the surface micro hardness of each of the fixing belts were listed in Table 7-1 to Table 7-2. Furthermore, the detection temperature in the thermocouple, as the evaluation result of the ability of the fixing belt according to each of Examples and Comparative Examples to supply heat was shown in Table 8.

In Examples A-11 to A-16 and Comparative Examples A-6 to A-8, the following respective fillers were used, and described together with the respective volume heat capacities ($C_p \cdot \rho$).

Example A-11, Example A-15 zinc oxide (trade name: LPZINC-11; produced by Sakai Chemical Industry Co., Ltd.): 3.02 [mJ/m$^3$·K];

Example A-12 magnesium oxide (trade name: Star Mag U; produced by Hayashi-Kasei Co., Ltd.): 3.24 [mJ/m$^3$·K];

Example A-13 copper powder (trade name: Cu-HWQ; produced by Fukuda Metal Foil & Powder Co., Ltd.): 3.43 [mJ/m$^3$·K];

Example A-14 nickel powder (trade name: Ni-S25-35; produced by Fukuda Metal Foil & Powder Co., Ltd.): 3.98 [mJ/m$^3$·K];

Example A-15 vapor grown carbon fiber (trade name: carbon nanofiber • VGCF-H; produced by Showa Denko K. K.): 3.24 [mJ/m$^3$·K];

Example A-16 vapor grown carbon fiber (trade name: carbon nanofiber ∩ VGCF; produced by Showa Denko K. K.): 3.24 [mJ/m$^3$·K];

Example A-16 iron powder (trade name: JIP S-100; produced by JFE Steel Corporation): 3.48 [mJ/m$^3$·K];

Comparative Example A-6 silica (trade name: FB-7SDC; produced by Denki Kagaku Kogyo K. K.): 1.64 [mJ/m$^3$·K];

Comparative Example A-7 metallic silicon powder (trade name: M-Si300; produced by Kanto Metal Corporation): 1.66 [mJ/m$^3$·K]; and Comparative Example A-8 powder (trade name: high-purity spherical aluminum powder; produced by Toyo Aluminum K. K.): 2.43 [mJ/m$^3$·K].

In addition, the fixing belt produced in Comparative Example A-1 was loaded on a color laser printer in the same manner as in Example A-1, and the image for evaluation was used to perform image quality evaluation under the same conditions. As a result, the micro hardness of the surface of the fixing belt was high, and thus it was difficult to follow irregularities of paper fibers, resulting in an electrophotographic image on which gloss unevenness was very remarkable.

Example B-1

An elastic layer was formed on a nickel-plated endless sleeve in the same manner as in Example A-1. The surface of the elastic layer was uniformly coated with a fluororesin dispersion coating material (trade name: Neoflon PFA dispersion • AD-2CRE; produced by Daikin Industries Ltd.) by a spray coating method, and the resultant was heated in an electric furnace set at 350° C. for 10 minutes.

The resultant was taken out from the electric furnace, and then cooled in a water bath at 25° C. to form a releasing layer on the surface of the elastic layer by a fluororesin coating method. Both ends of the resulting endless belt were cut to provide a fixing belt having a width of 341 mm. The ends cut were observed by a microscope, and the thickness of the releasing layer was 10 μm.

The thermal effusivity b3 of the fluororesin releasing layer formed here was 0.74 [kJ/(m$^2$·K·sec$^{0.5}$)], and was approximately close to the thermal effusivity value of the fluororesin tube.

A test piece of 20 mm×20 mm for thermophysical property measurement was cut out from ends cut from the fixing belt, the surface thereof on the releasing layer was subjected to Mo sputtering, and then the test piece was placed on a specimen stage of a light heating thermoreflectance method-thermophysical property microscope. The AC frequency f of a alternating-current temperature wave of a heating laser was sequentially changed to 10, 20, 33 and 50 Hz to measure the thermal effusivity in the same manner as in Example A-1, and the thermal effusivities $b_f$ were each as follows: $b_{10}$=1.89, $b_{20}$=1.85, $b_{22}$=1.81 and $b_{50}$=1.76 [kJ/(m$^2$·K·sec$^{0.5}$)].

In addition, the surface hardness of the resulting fixing belt was measured by using a Type C micro hardness tester, and as a result, the average surface micro hardness was 74 degrees. The results are shown in Table 7-3.

The fixing belt was loaded on the fixing unit in the same manner as in Example A-1, the temperature evaluation paper was used to evaluate the ability to supply heat under the respective dwell time conditions of 100 msec, 50 msec, 30 msec and 20 msec, and the detection temperatures were 167° C., 159° C., 148° C. and 129° C, respectively. The results are shown in Table 8.

(Example B-2) to (Example B-3) and (Comparative Example B-1) to (Comparative Example B-2)

The type and the amount of the filler in the silicone rubber admixture were changed as listed in Table 5-2. Each of fixing belts was prepared in the same manner as in Example B-1 except for such changes, and evaluated. The thermal effusivity b3 of each of releasing layers was listed in Table 6-2. The thermal effusivities $b_{10}$, $b_{20}$, $b_{33}$ and $b_{50}$ of the temperature frequencies of each of fixing belts according to the respective Examples and Comparative Examples, and the surface micro hardness of each of the fixing belts were listed in Table 7-3. Furthermore, the detection temperature in the thermocouple, as the evaluation result of the ability of each of the fixing belts to supply heat, is shown in Table 8.

Example C-1

As a substrate, a stainless core whose surface was subjected to primer treatment, having a diameter of 10 mm, was prepared. A silicone rubber (trade name: DY35-561; "A-liquid" and "B-liquid" produced by Dow Corning Toray Co., Ltd. were mixed in equal amounts) was applied onto the substrate for molding by a mold forming method so that the thickness was 2 mm, providing an elastic underlayer. The outer surface of the elastic underlayer was further coated with the same silicone rubber admixture as the admixture used in Example A-4 by using a ring coating method so that the thickness was 150 μm.

The resulting core coated was heated in an electric furnace set at 200° C. for 4 hours to cure the silicone rubber, providing a roller-shaped molded product in which an elastic intermediate layer was formed. The thermal effusivity b1 of the elastic intermediate layer was 2.28 [kJ/(m$^2$·K·sec$^{0.5}$)]. The result is shown in Table 5-3.

Vapor grown carbon fibers (VGCF-S) were added to the adhesive used in Example A-1 in a volume ratio of 2% to provide an adhesive admixture. The surface of the roller-shaped molded product was coated with the adhesive admixture in a substantially uniform manner so that the thickness was about 20 μm.

Then, a fluororesin tube (trade name: KURANFLON-LT; produced by Kurabo Industries Ltd.) having an inner diameter of 14 mm and a thickness of 10 μm was produced by stacking in the same manner as in Example A-1 as illustrated in FIG. 4. Thereafter, the surface of the roller-shaped molded product was uniformly squeezed from the top of the fluororesin tube, and thus an excessive amount of the adhesive was squeezed out from a space between the elastic intermediate layer and the fluororesin tube so that the product was sufficiently thinned.

Then, the roller-shaped molded product was heated in an electric furnace set at 200° C. for 1 hour to thereby cure the adhesive, to secure the fluororesin tube on the elastic intermediate layer, thereby providing a fixing roller.

The same fixing roller was cut into round slices, and the edge of each of the slices was observed by a microscope and the thickness of the adhesive layer was 8 μm.

The thermal effusivity b3 of the fluororesin tube releasing layer used here was 0.71 [kJ/(m$^2$·K·sec$^{0.5}$)], and the thermal effusivity b2 of the adhesive layer was 1.21 [kJ/(m$^2$·K·sec$^{0.5}$)]. The results are shown in Table 6-2.

A test piece of 20 mm×20 mm for thermophysical property measurement was cut out at a depth of 1 mm from the surface of the roller produced in the same manner, the surface thereof on the releasing layer was subjected to Mo sputtering, and then the test piece was placed on a specimen stage of a light heating thermoreflectance method-thermophysical property microscope. The AC frequency f of a alternating-current temperature wave of a heating laser was sequentially changed to 10, 20, 33 and 50 Hz to measure the thermal effusivity in the same manner as in Example A-1, and the thermal effusivities $b_f$ were each as follows: $b_{10}$=2.21, $b_{20}$=2.13, $b_{33}$=2.04 and $b_{50}$=1.93 [kJ/(m$^2$·K·sec$^{0.5}$)].

The surface hardness of the resulting fixing roller was measured by using a Type C micro hardness tester, and as a result, the average surface micro hardness was 79 degrees. The results are shown in Table 7-3.

Each of pressure rollers was produced by the above steps excluding the step of molding an elastic intermediate layer, and each of the pressure rollers was loaded on the fixing apparatus illustrated in FIG. 7.

The pressurizing force between the rollers was set to 20 Kgf by a pressure unit non-illustrated, and the nip width between the rollers was measured by the pressure-sensitive paper and was 4.5 mm. The rotation speed of the fixing roller was adjusted so that the conveyance velocity of the member to be heated was 45 mm/sec, and the external heating unit 20 was electrified under control to thereby perform temperature regulation control so that the surface temperature of the fixing roller was 185° C. Thus, a member to be recorded was allowed to pass through a fixing nip portion in an environment of a dwell time T of 100 msec.

The temperature evaluation paper was allowed to pass through the fixing nip portion N in the fixing apparatus set in an environment of a dwell time T of 100 msec to thereby evaluate the ability to supply heat in the same manner as in Example A-1, and the detection temperature in the thermocouple was 172° C. The results of the detection temperatures in the thermocouple at dwell times of 50 msec, 30 msec and 20 msec are also shown in Table 8.

Comparative Example C-1

Each of members was produced and evaluations were performed in the same manner as in Example C-1 except that the same silicone rubber admixture as the admixture used in Comparative Example A-1 was used in the elastic layer of the fixing member.

The detection temperature in the thermocouple by the temperature evaluation paper obtained by using the present fixing roller is shown in Table 8.

Example C-2

As materials of a fluororesin tube for a releasing layer, a PFA resin pellet (trade name: PFA420HPJ; produced by Du Pont-Mitsui Fluorochemicals Co., Ltd.) and vapor grown carbon fibers (trade name: carbon nanofiber • VGCF-S; produced by Showa Denko K. K.) were prepared. The PFA resin pellet in a volume percent of 98% and the vapor grown carbon fibers in a volume percent of 2% were mixed, mixed by a Henschel mixer in a dry manner, and allowed to pass through an extruding machine to be formed into a pellet. The pellet was formed into a fluororesin tube having an inner diameter of 14 mm and a thickness of 30 μm by using an extrusion molding machine to thereby provide a fluororesin tube for a releasing layer.

The thermophysical properties of the resulting fluororesin tube were measured, and the heat conductivity λ was 0.50 [W/(m·K)], the specific heat at constant pressure Cp was 0.96 [J/(g·K)], the density ρ was 2.17 [g/cm$^3$] and the thermal effusivity b3 of the single fluororesin tube was 1.02 [kJ/(m$^2$·K·sec$^{0.5}$)].

A fixing roller was obtained by forming an elastic underlayer and an elastic intermediate layer on a core in the same manner as in Example C-1, preparing the adhesive used in Example A-1 as an adhesive, and stacking and curing the fluororesin tube in the same manner as in Example C-1. The thermal effusivity and the surface micro hardness of the roller are shown in Table 7-3.

In addition, the detection temperature in the thermocouple by the temperature evaluation paper obtained by using the present fixing roller is shown in Table 8.

(Example C-3) to (Example C-5)

The type and the amount of the filler in the silicone rubber admixture were changed as listed in Table 5-3. In addition, the adhesive layer and the releasing layer were changed to each configuration listed in Table 6-2 to produce each fixing roller, and the evaluations according to Example C-1 were performed. The thermal effusivities $b_{10}$, $b_{20}$, $b_{33}$ and $b_{50}$ of the temperature frequencies of each of the fixing roller, and the surface micro hardness of each of the fixing rollers were shown in Table 7-3, and the detection temperature in the thermocouple by the evaluation result of the ability to supply heat was shown in Table 8.

TABLE 5-1

| | Elastic layer | | | | | | | |
|---|---|---|---|---|---|---|---|---|
| | Elastic layer | Volume percent of silicone rubber | Type of filler | Volume percent of filler | Type of filler | Volume percent of filler | Thickness of elastic layer [μm] | Thermal effusivity $b_1$ of elastic layer [kJ/(m2 · K · sec 0.5)] |
| Example A-1 | A | 63% | Alumina | 35% | VGCF-S | 2% | 300 | 1.97 |
| Example A-2 | A | 63% | Alumina | 35% | VGCF-S | 2% | 300 | 1.97 |
| Example A-3 | B | 53% | Alumina | 45% | VGCF-S | 2% | 300 | 2.36 |
| Example A-4 | B | 53% | Alumina | 45% | VGCF-S | 2% | 300 | 2.37 |
| Example A-5 | C | 73% | Alumina | 25% | VGCF | 2% | 300 | 1.65 |
| Example A-6 | D | 67% | Alumina | 30% | VGCF-S | 3% | 300 | 1.92 |
| Example A-7 | E | 53% | Zinc oxide | 45% | VGCF-S | 2% | 300 | 2.32 |
| Example A-8 | F | 53% | Magnesium oxide | 45% | VGCF-S | 2% | 300 | 2.61 |
| Example A-9 | G | 53% | Copper powder | 45% | VGCF-S | 2% | 300 | 2.79 |
| Example A-10 | H | 53% | Nickel powder | 45% | VGCF-S | 2% | 300 | 2.85 |
| Example A-11 | I | 49% | Zinc oxide | 50% | VGCF | 1% | 300 | 1.86 |
| Example A-12 | J | 54% | Iron powder | 45% | VGCF-H | 1% | 300 | 2.09 |
| Comparative Example A-1 | K | 50% | Alumina | 50% | — | — | 300 | 1.73 |
| Comparative Example A-2 | L | 45% | Alumina | 55% | — | — | 300 | 1.88 |

TABLE 5-1-continued

| | Elastic layer | | | | | | | |
|---|---|---|---|---|---|---|---|---|
| | Elastic layer | Volume percent of silicone rubber | Type of filler | Volume percent of filler | Type of filler | Volume percent of filler | Thickness of elastic layer [μm] | Thermal effusivity $b_1$ of elastic layer [kJ/(m2 · K · sec 0.5)] |
| Comparative Example A-3 | M | 55% | Alumina | 45% | — | — | 300 | 1.36 |
| Comparative Example A-4 | N | 65% | Alumina | 35% | — | — | 300 | 1.20 |
| Comparative Example A-5 | O | 100% | — | 0% | — | — | 300 | 0.56 |
| Comparative Example A-6 | P | 98% | — | 0% | VGCF-S | 2% | 300 | 1.05 |
| Comparative Example A-7 | Q | 94% | — | 0% | VGCF-S | 5% | 300 | 1.43 |
| Comparative Example A-8 | R | 53% | Silica | 45% | VGCF-S | 2% | 300 | 1.21 |
| Comparative Example A-9 | S | 53% | Metal silicon powder | 45% | VGCF-S | 2% | 300 | 1.34 |
| Comparative Example A-10 | T | 43% | Aluminum powder | 55% | VGCF-S | 2% | 300 | 1.93 |

TABLE 5-2

| | Elastic layer | | | | | | | |
|---|---|---|---|---|---|---|---|---|
| Example | Elastic layer | Volume percent of silicone rubber | Type of filler | Volume percent of filler | Type of filler | Volume percent of fillerr | Thickness of elastic layer [μm] | Thermal effusivity $b_1$ of elastic layer [kJ/(m2 · K · sec 0.5)] |
| Example B-1 | A | 63% | Alumina | 35% | VGCF-S | 2% | 300 | 1.97 |
| Example B-2 | B | 53% | Alumina | 45% | VGCF-S | 2% | 300 | 2.36 |
| Example B-3 | D | 67% | Alumina | 30% | VGCF-S | 3% | 300 | 1.92 |
| Comparative Example B-1 | N | 65% | Alumina | 35% | — | — | 300 | 1.20 |
| Comparative Example B-2 | U | 45% | Nickel powder | 55% | — | — | 300 | 2.20 |

TABLE 5-3

| | Elastic layer | | | | | | | |
|---|---|---|---|---|---|---|---|---|
| Example | Elastic layer | Volume percent of silicone rubber | Type of filler | Volume percent of filler | Type of filler | Volume percent of filler | Thickness of elastic layer [μm] | Thermal effusivity $b_1$ of elastic layer [kJ/(m2 · K · sec 0.5)] |
| Example C-1 | B | 53% | Alumina | 45% | VGCF-S | 2% | 150 | 2.37 |
| Example C-2 | B | 53% | Alumina | 45% | VGCF-S | 2% | 150 | 2.37 |
| Example C-3 | V | 55% | Nickel powder | 45% | — | — | 150 | 1.97 |
| Example C-4 | V | 55% | Nickel powder | 45% | — | — | 150 | 1.97 |

TABLE 5-3-continued

| | Elastic layer | | | | | | | |
|---|---|---|---|---|---|---|---|---|
| Example | Elastic layer | Volume percent of silicone rubber | Type of filler | Volume percent of filler | Type of filler | Volume percent of filler | Thickness of elastic layer [μm] | Thermal effusivity $b_1$ of elastic layer [kJ/(m2 · K · sec 0.5)] |
| Example C-5 | B | 53% | Alumina | 45% | VGCF-S | 2% | 150 | 2.37 |
| Comparative Example C-1 | K | 50% | Alumina | 50% | — | — | 150 | 1.73 |

TABLE 6-1

| | Adhesive layer | | | Releasing layer | | |
|---|---|---|---|---|---|---|
| | Material | Thickness of adhesive layer [μm] | Thermal effusivity $b_2$ of adhesive layer [kJ/(m2 · K · sec 0.5)] | Material | Thickness of releasing layer [μm] | Thermal effusivity $b_3$ of releasing layer [kJ/(m2 · K · sec 0.5)] |
| Example A-1 | [SE1819CV] | 5 | 0.61 | 451HPJ PFA tube | 10 | 0.71 |
| Example A-2 | [SE1819CV] | 5 | 0.61 | 451HPJ PFA tube | 30 | 0.71 |
| Example A-3 | [SE1819CV] | 5 | 0.61 | 451HPJ PFA tube | 10 | 0.71 |
| Example A-4 | [SE1819CV] | 5 | 0.61 | 451HPJ PFA tube | 25 | 0.71 |
| Example A-5 | [SE1819CV] | 5 | 0.61 | 451HPJ PFA tube | 10 | 0.71 |
| Example A-6 | [SE1819CV] | 5 | 0.61 | 451HPJ PFA tube | 10 | 0.71 |
| Example A-7 | [SE1819CV] | 5 | 0.61 | 451HPJ PFA tube | 15 | 0.71 |
| Example A-8 | [SE1819CV] | 5 | 0.61 | 451HPJ PFA tube | 10 | 0.71 |
| Example A-9 | [SE1819CV] | 5 | 0.61 | 451HPJ PFA tube | 20 | 0.71 |
| Example A-10 | [SE1819CV] | 5 | 0.61 | 451HPJ PFA tube | 10 | 0.71 |
| Example A-11 | [SE1819CV] | 5 | 0.61 | 451HPJ PFA tube | 25 | 0.71 |
| Example A-12 | [SE1819CV] | 5 | 0.61 | 451HPJ PFA tube | 15 | 0.71 |
| Comparative Example A-1 | [SE1819CV] | 5 | 0.61 | 451HPJ PFA tube | 10 | 0.71 |
| Comparative Example A-2 | [SE1819CV] | 5 | 0.61 | 451HPJ PFA tube | 10 | 0.71 |
| Comparative Example A-3 | [SE1819CV] | 5 | 0.61 | 451HPJ PFA tube | 10 | 0.71 |
| Comparative Example A-4 | [SE1819CV] | 5 | 0.61 | 451HPJ PFA tube | 10 | 0.71 |
| Comparative Example A-5 | [SE1819CV] | 5 | 0.61 | 451HPJ PFA tube | 10 | 0.71 |
| Comparative Example A-6 | [SE1819CV] | 5 | 0.61 | 451HPJ PFA tube | 10 | 0.71 |
| Comparative Example A-7 | [SE1819CV] | 5 | 0.61 | 451HPJ PFA tube | 10 | 0.71 |
| Comparative Example A-8 | [SE1819CV] | 5 | 0.61 | 451HPJ PFA tube | 30 | 0.71 |
| Comparative Example A-9 | [SE1819CV] | 5 | 0.61 | 451HPJ PFA tube | 10 | 0.71 |
| Comparative Example A-10 | [SE1819CV] | 5 | 0.61 | 451HPJ PFA tube | 10 | 0.71 |

TABLE 6-2

| Example | Adhesive layer Material | Thickness of adhesive layer [μm] | Thermal effusivity $b_2$ of adhesive layer [kJ/(m2 · K · sec 0.5)] | Releasing layer Material | Thickness of releasing layer [μm] | Thermal effusivity $b_3$ of releasing layer [kJ/(m2 · K · sec 0.5)] |
|---|---|---|---|---|---|---|
| Example B-1 | — | — | — | PFA coat [AD-2CRE] | 10 | 0.75 |
| Example B-2 | — | — | — | PFA coat [AD-2CRE] | 10 | 0.75 |
| Example B-3 | — | — | — | PFA coat [AD-2CRE] | 10 | 0.75 |
| Comparative Example B-1 | — | — | — | PFA coat [AD-5CRE] | 10 | 0.75 |
| Comparative Example B-2 | — | — | — | PFA coat [AD-2CRE] | 10 | 0.75 |
| Example C-1 | SE1819CV + VGCF2% | 8 | 1.21 | PFA tube[451HPJ] | 10 | 0.71 |
| Example C-2 | SE1819CV | 5 | 0.61 | PFA tube[420HPJ] + [VGCF-S] | 30 | 1.02 |
| Example C-3 | SE1819CV | 5 | 0.61 | PFA tube[420HPJ] + [VGCF-S] | 30 | 1.02 |
| Example C-4 | SE1819CV + VGCF2% | 8 | 1.21 | PFA tube[420HPJ] + [VGCF-S] | 30 | 1.02 |
| Example C-5 | SE1819CV + VGCF2% | 8 | 1.21 | PFA tube[420HPJ] + [VGCF-S] | 30 | 1.02 |
| Comparative Example C-1 | SE1819CV + VGCF2% | 8 | 1.21 | PFA tube[451HPJ] | 10 | 0.71 |

TABLE 7-1

| Example | Thermal diffusion length $\mu_{10}$ at AC frequency of 10 Hz [μm] | Thermal effusivity $b_{10}$ in range from surface to $\mu_{10}$ [kJ/(m2 · K · sec 0.5)] | Thermal diffusion length $\mu_{20}$ at AC frequency of 20 Hz [μm] | Thermal effusivity $b_{20}$ in range from surface to $\mu_{20}$ [kJ/(m2 · K · sec 0.5)] | Thermal diffusion length $\mu_{33}$ at AC frequency of 33 Hz [μm] | Thermal effusivity $b_{33}$ in range from surface to $\mu_{33}$ [kJ/(m2 · K · sec 0.5)] | Thermal diffusion length $\mu_{50}$ at AC frequency of 50 Hz [μm] | Thermal effusivity $b_{50}$ in range from surface to $\mu_{50}$ [kJ/(m2 · K · sec 0.5)] | Surface micro hardness [°] |
|---|---|---|---|---|---|---|---|---|---|
| Example A-1 | 140.5 | 1.83 | 91.5 | 1.76 | 64.8 | 1.67 | 48.0 | 1.57 | 76 |
| Example A-2 | 105.2 | 1.55 | 56.2 | 1.18 | 40.5 | 0.87 | 41.2 | 0.88 | 78 |
| Example A-3 | 156.7 | 2.20 | 100.9 | 2.12 | 70.9 | 2.01 | 52.0 | 1.88 | 79 |
| Example A-4 | 124.4 | 1.97 | 69.3 | 1.64 | 39.4 | 1.09 | 39.5 | 1.10 | 80 |
| Example A-5 | 128.2 | 1.54 | 84.0 | 1.48 | 59.9 | 1.41 | 44.7 | 1.33 | 73 |
| Example A-6 | 140.5 | 1.79 | 91.5 | 1.71 | 64.8 | 1.63 | 48.0 | 1.53 | 75 |
| Example A-7 | 142.9 | 2.09 | 89.0 | 1.95 | 59.6 | 1.77 | 41.1 | 1.52 | 82 |
| Example A-8 | 163.7 | 2.43 | 105.6 | 2.33 | 74.0 | 2.22 | 54.1 | 2.07 | 81 |
| Example A-9 | 144.7 | 2.43 | 84.7 | 2.17 | 52.1 | 1.78 | 31.5 | 1.12 | 84 |
| Example A-10 | 151.2 | 2.63 | 98.0 | 2.52 | 69.0 | 2.38 | 50.8 | 2.21 | 85 |
| Example A-11 | 102.2 | 1.52 | 60.1 | 1.28 | 37.2 | 0.92 | 37.3 | 0.92 | 84 |
| Example A-12 | 122.3 | 1.86 | 77.4 | 1.73 | 53.0 | 1.56 | 37.6 | 1.34 | 85 |

TABLE 7-2

| | Thermal diffusion length $\mu_{10}$ at AC frequency of 10 Hz [μm] | Thermal effusivity $b_{10}$ in range from surface to $\mu_{10}$ [kJ/(m2 · K · sec 0.5)] | Thermal diffusion length $\mu_{20}$ at AC frequency of 20 Hz [μm] | Thermal effusivity $b_{20}$ in range from surface to $\mu_{20}$ [kJ/(m2 · K · sec 0.5)] | Thermal diffusion length $\mu_{33}$ at AC frequency of 33 Hz [μm] | Thermal effusivity $b_{33}$ in range from surface to $\mu_{33}$ [kJ/(m2 · K · sec 0.5)] | Thermal diffusion length $\mu_{50}$ at AC frequency of 50 Hz [μm] | Thermal effusivity $b_{50}$ in range from surface to $\mu_{50}$ [kJ/(m2 · K · sec 0.5)] | Surface micro hardness [°] |
|---|---|---|---|---|---|---|---|---|---|
| Comparative Example A-1 | 115.8 | 1.59 | 76.4 | 1.52 | 55.0 | 1.44 | 41.5 | 1.35 | 93 |
| Comparative Example A-2 | 121.5 | 1.73 | 79.9 | 1.66 | 57.3 | 1.57 | 43.0 | 1.46 | 95 |
| Comparative Example A-3 | 97.9 | 1.26 | 65.5 | 1.21 | 47.9 | 1.15 | 36.8 | 1.09 | 79 |
| Comparative Example A-4 | 92.8 | 1.12 | 62.4 | 1.08 | 45.9 | 1.03 | 35.4 | 0.98 | 75 |
| Comparative Example A-5 | 63.5 | 0.59 | 44.3 | 0.60 | 34.1 | 0.61 | 27.6 | 0.62 | 69 |
| Comparative Example A-6 | 104.2 | 1.00 | 69.2 | 0.97 | 50.3 | 0.94 | 38.4 | 0.91 | 71 |
| Comparative Example A-7 | 131.9 | 1.34 | 86.2 | 1.30 | 61.4 | 1.25 | 45.7 | 1.18 | 82 |
| Comparative Example A-8 | 90.7 | 1.01 | 51.8 | 0.86 | 39.4 | 0.75 | 39.9 | 0.76 | 83 |
| Comparative Example A-9 | 124.7 | 1.26 | 81.9 | 1.22 | 58.5 | 1.17 | 43.8 | 1.11 | 82 |
| Comparative Example A-10 | 139.7 | 1.80 | 91.0 | 1.72 | 64.5 | 1.64 | 47.8 | 1.54 | 94 |

TABLE 7-3

| | Thermal diffusion length $\mu_{10}$ at AC frequency of 10 Hz [μm] | Thermal effusivity $b_{10}$ in range from surface to $\mu_{10}$ [kJ/(m2 · K · sec 0.5)] | Thermal diffusion length $\mu_{20}$ at AC frequency of 20 Hz [μm] | Thermal effusivity $b_{20}$ in range from surface to $\mu_{20}$ [kJ/(m2 · K · sec 0.5)] | Thermal diffusion length $\mu_{33}$ at AC frequency of 33 Hz [μm] | Thermal effusivity $b_{33}$ in range from surface to $\mu_{33}$ [kJ/(m2 · K · sec 0.5)] | Thermal diffusion length $\mu_{50}$ at AC frequency of 50 Hz [μm] | Thermal effusivity $b_{50}$ in range from surface to $\mu_{50}$ [kJ/(m2 · K · sec 0.5)] | Surface micro hardness [°] |
|---|---|---|---|---|---|---|---|---|---|
| Example B-1 | 150.8 | 1.89 | 101.8 | 1.85 | 75.1 | 1.81 | 58.3 | 1.76 | 74 |
| Example B-2 | 167.7 | 2.26 | 113.1 | 2.23 | 83.2 | 2.18 | 64.3 | 2.12 | 80 |
| Example B-3 | 150.8 | 1.84 | 101.8 | 1.80 | 75.1 | 1.76 | 58.3 | 1.72 | 73 |
| Comparative Example B-1 | 97.3 | 1.16 | 66.9 | 1.13 | 50.4 | 1.11 | 39.9 | 1.09 | 73 |
| Comparative Example B-2 | 119.0 | 2.08 | 81.1 | 2.02 | 60.4 | 1.96 | 46.6 | 1.89 | 98 |
| Example C-1 | 162.2 | 2.21 | 107.1 | 2.13 | 77.1 | 2.04 | 58.2 | 1.93 | 79 |
| Example C-2 | 142.5 | 2.03 | 87.4 | 1.81 | 57.5 | 1.51 | 38.6 | 1.09 | 80 |
| Example C-3 | 107.6 | 1.64 | 70.4 | 1.47 | 50.2 | 1.27 | 37.4 | 1.03 | 83 |
| Example C-4 | 112.8 | 1.66 | 75.6 | 1.51 | 55.3 | 1.34 | 42.6 | 1.16 | 84 |
| Example C-5 | 148.7 | 2.04 | 93.6 | 1.84 | 63.7 | 1.59 | 44.8 | 1.26 | 81 |
| Comparative Example C-1 | 121.1 | 1.61 | 81.7 | 1.55 | 60.3 | 1.49 | 46.8 | 1.42 | 94 |

TABLE 8

| | Gloss unevenness evaluation result | Detection temperature in thermocouple [° C.] |
|---|---|---|
| Example A-1 | A | 144 |
| Example A-2 | A | 135 |
| Example A-3 | A | 152 |
| Example A-4 | A | 148 |
| Example A-5 | A | 135 |
| Example A-6 | A | 143 |
| Example A-7 | B | 151 |
| Example A-8 | B | 155 |
| Example A-9 | B | 154 |
| Example A-10 | B | 158 |
| Example A-11 | B | 135 |
| Example A-12 | B | 147 |
| Comparative Example A-1 | C | 131 |
| Comparative Example A-2 | C | 136 |
| Comparative Example A-3 | A | 122 |
| Comparative Example A-4 | A | 120 |
| Comparative Example A-5 | A | 95 |
| Comparative Example A-6 | A | 114 |
| Comparative Example A-7 | B | 124 |
| Comparative Example A-8 | B | 115 |
| Comparative Example A-9 | B | 121 |
| Comparative Example A-10 | C | 138 |
| Example B-1 | A | 147 |
| Example B-2 | A | 153 |
| Example B-3 | A | 146 |
| Comparative Example B-1 | A | 119 |
| Comparative Example B-2 | C | 145 |
| Example C-1 | A | 152 |
| Example C-2 | A | 148 |
| Example C-3 | B | 138 |
| Example C-4 | B | 138 |
| Example C-5 | B | 147 |
| Comparative Example C-1 | C | 132 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-277247, filed Dec. 19, 2012, and Japanese Patent Application No. 2012-282972, filed Dec. 26, 2012, which are hereby incorporated by reference herein in their entirety.

REFERENCE SIGNS LIST

N fixing nip
P material to be recorded
G unfixed toner
V conveyance velocity of member to be recorded
1 fixing belt
2 fixing roller
3 substrate
4 elastic layer
4*a* base material (silicone rubber)
4*b* filling material having high volume heat capacity
4*c* vapor grown carbon fibers
5 adhesive layer
6 releasing layer
7 cylinder pump
8 supply nozzle of coating liquid
9 coating head
10 coat of uncrosslinked elastic layer
11 adhesive
12 fluororesin tube
13 core cylinder
14 spray gun
15 coat of fluororesin coating material
16 belt guide member
17 ceramic heater
18 pressurizing rigid stay
19 elastic pressure roller
19*a* stainless core
19*b* elastic layer
19*c* surface layer
20 external heating unit
20*a* halogen heater
20*b* reflection mirror
20*c* shutter
20*d* temperature detection element
21 charging apparatus
22 scanner unit
23 developing unit
24 primary transfer roller
25 cleaning unit
26•27•28 roller for hanging intermediate transfer member
29 feeding cassette
30 feeding roller
31 separation pad
32 pair of resist rollers
33 secondary transfer roller
34 conveyance belt
35 fixing portion
36 pair of discharge rollers
37 discharge tray
38 intermediate transfer member
39 photosensitive drum
40 color laser printer

What is claimed is:

1. An electrophotographic fixing member comprising:
a substrate;
an elastic layer; and
a releasing layer,
wherein thermal effusivity in a depth region from a surface of the releasing layer is 1.5 [kJ/(m$^2$·K·sec$^{0.5}$)] or more, the depth region corresponding to a thermal diffusion length when an alternating-current temperature wave having a frequency of 10 Hz is applied to the surface of the releasing layer, and
wherein a surface micro rubber hardness is 85 degrees or less.

2. An electrophotographic fixing member comprising:
an elastic layer; and
a releasing layer,
wherein thermal effusivity in a depth region from a surface of the releasing layer is 1.5 [kJ/(m$^2$·K·sec$^{0.5}$)] or more, the depth region corresponding to a thermal diffusion length when an alternating-current temperature wave having an AC frequency of 20 Hz is applied to the surface of the releasing layer, and
wherein a surface micro rubber hardness is 85 degrees or less.

3. An electrophotographic fixing member comprising:
a substrate;
an elastic layer; and
a releasing layer,
wherein thermal effusivity in a depth region from a surface of the releasing layer is 1.5 [kJ/($m^2$·K·$sec^{0.5}$)] or more, the depth region corresponding to a thermal diffusion length when an alternating-current temperature wave having an AC frequency of 33 Hz is applied to the surface of the releasing layer, and
wherein a surface micro rubber hardness is 85 degrees or less.

4. An electrophotographic fixing member comprising:
a substrate;
an elastic layer; and
a releasing layer,
wherein thermal effusivity in a depth region from a surface of the releasing layer is 1.5 [kJ/($m^2$·K·$sec^{0.5}$)] or more, the depth region corresponding to a thermal diffusion length when an alternating-current temperature wave having an AC frequency of 50 Hz is applied to the surface of the releasing layer, and
wherein a surface micro rubber hardness is 85 degrees or less.

5. The electrophotographic fixing member according to claim 1, wherein the surface micro rubber hardness is 80 degrees or less.

6. The fixing member according to claim 1, wherein:
the elastic layer comprises a silicone rubber, and
the releasing layer comprises a fluororesin.

7. The fixing member according to claim 1, wherein the elastic layer contains an inorganic filler having a volume heat capacity of 3.0 [mJ/$m^3$·K] or more, and vapor grown carbon fibers.

8. The fixing member according to claim 7, wherein the inorganic filler is made of at least one selected from the group consisting of alumina, magnesium oxide, zinc oxide, iron, copper and nickel.

9. The electrophotographic fixing member according to claim 1, wherein the releasing layer contains vapor grown carbon fibers.

10. The fixing member according to claim 1, further having an adhesive layer between the releasing layer and the elastic layer.

11. The fixing member according to claim 10, wherein the adhesive layer contains vapor grown carbon fibers.

12. A fixing apparatus comprising the fixing member according to claim 1, and a heating unit of the fixing member.

13. An electrophotographic image forming apparatus comprising the fixing apparatus according to claim 12.

* * * * *